US011686136B2

(12) United States Patent
Ridley

(10) Patent No.: US 11,686,136 B2
(45) Date of Patent: Jun. 27, 2023

(54) HINGE, LEAF AND ASSOCIATED METHODS

(71) Applicant: SAFEHINGE LIMITED, Glasgow (GB)

(72) Inventor: Shaun Ridley, Glasgow (GB)

(73) Assignee: SAFEHINGE PRIMERA LIMITED, Glasgow (GB)

( * ) Notice: Subject to any disclaimer, the term of this patent is extended or adjusted under 35 U.S.C. 154(b) by 703 days.

(21) Appl. No.: 16/603,447

(22) PCT Filed: Apr. 10, 2018

(86) PCT No.: PCT/EP2018/059206
§ 371 (c)(1),
(2) Date: Oct. 7, 2019

(87) PCT Pub. No.: WO2018/189206
PCT Pub. Date: Oct. 18, 2018

(65) Prior Publication Data

US 2020/0149330 A1 May 14, 2020

(30) Foreign Application Priority Data

Apr. 10, 2017 (GB) ..... 1705775
Oct. 8, 2017 (GB) ..... 1716453

(51) Int. Cl.
*E05D 11/00* (2006.01)
*E05D 7/10* (2006.01)
(Continued)

(52) U.S. Cl.
CPC ..... *E05D 7/1044* (2013.01); *E05D 3/02* (2013.01); *E05D 7/081* (2013.01); *E05D 7/1005* (2013.01);
(Continued)

(58) Field of Classification Search
CPC ..... E05D 7/104; E05D 7/081; E05D 7/10; E05D 7/1005; E05D 7/1011;
(Continued)

(56) References Cited

U.S. PATENT DOCUMENTS 2,686,941 A 8/1954 Patten
3,378,881 A * 4/1968 Hentzi ..... E05D 7/081 16/312
(Continued)

FOREIGN PATENT DOCUMENTS

CN 202500418 U * 10/2012
JP 2002021411 1/2002
(Continued)

OTHER PUBLICATIONS

International Search Report, for International Application No. PCT/EP2018/059206; dated Jun. 20, 2018.

*Primary Examiner* — Chuck Y Mah
(74) *Attorney, Agent, or Firm* — Dickinson Wright PLLC

(57) ABSTRACT

An anti-ligature hinge for a door and associated methods and systems are provided. The anti-ligature hinge has a hinge bracket operatively associable with a support and a hinge member operatively associable with a leaf. The hinge member is connectable to the hinge bracket and rotatable relative to the hinge bracket about an axis of rotation. The hinge member can disconnect from the hinge bracket in response to a threshold force acting along or transverse to the axis or rotation. This hinge is for eliminating ligature points in doors where vulnerable individuals are to be left unsupervised.

19 Claims, 7 Drawing Sheets

(51) Int. Cl.
*E05D 3/02* (2006.01)
*E05D 7/081* (2006.01)
*E06B 7/28* (2006.01)

(52) U.S. Cl.
CPC ..... *E05D 7/1061* (2013.01); *E06B 7/28* (2013.01); *E05D 2007/1038* (2013.01); *E05Y 2201/418* (2013.01); *E05Y 2201/46* (2013.01); *E05Y 2900/132* (2013.01)

(58) Field of Classification Search
CPC ... E05D 7/1022; E05D 7/1027; E05D 7/1033; E05D 7/1038; E05D 7/1061; E05D 3/02; E06B 7/28; E05Y 2007/1038; E05Y 2201/46; E05Y 2201/418; E05Y 2900/132; Y10T 16/521; Y10T 16/522; Y10T 16/535; Y10T 16/5355; Y10T 16/5357; Y10T 16/539; Y10T 16/536; Y10T 16/53607
See application file for complete search history.

(56) References Cited

U.S. PATENT DOCUMENTS 3,546,736 A * 12/1970 Booth ..... E05F 1/063 16/312
3,628,845 A * 12/1971 Grimm ..... E05F 1/063 16/312
3,707,017 A * 12/1972 Paquette ..... E05D 7/02 16/385
3,858,274 A * 1/1975 Burton ..... E05F 1/061 16/312
4,620,392 A * 11/1986 Kerpers ..... F25D 23/028 16/229
4,799,529 A * 1/1989 McAfee ..... E06B 3/9648 49/501
5,265,311 A * 11/1993 Gard ..... E05F 1/06 16/311
5,490,305 A * 2/1996 Domingo Ribot ..... E06B 7/362 16/229
5,553,352 A * 9/1996 Bolton ..... E05D 7/1011 16/229
6,158,087 A * 12/2000 Cheung ..... E05D 7/1005 16/374
7,089,627 B2 * 8/2006 Seidler ..... B65D 51/04 206/823
7,467,440 B2 * 12/2008 Seidler ..... B65D 51/04 16/320
8,839,561 B2 * 9/2014 Yagi ..... E05D 7/1044 16/320
2006/0254025 A1 * 11/2006 Danko ..... E05D 1/06 16/320
2008/0129953 A1 * 6/2008 Blum ..... G02C 11/10 351/158
2012/0096677 A1 * 4/2012 Ho ..... E05D 7/1072 16/250
2013/0111818 A1 5/2013 Yagi

FOREIGN PATENT DOCUMENTS

JP 2012122205 6/2012
JP 2012122205 A 6/2012
JP 2016065423 A * 4/2016

* cited by examiner 210
212
214
217
219
220
224
226
228
230
234
236
238
242
250
260

HINGE, LEAF AND ASSOCIATED METHODS

CROSS-REFERENCE TO RELATED APPLICATIONS

The present application is a Section 371 National Stage of International Application PCT/EP2018/059206, filed 10 Apr. 2018, and through which priority is claimed to UK Patent Application 1705775.3, filed 10 Apr. 2017, and UK Patent Application 1716453.4, filed 8 Oct. 2017.

TECHNICAL FIELD

This disclosure concerns a hinge, a leaf, and a leaf system, and associated methods. In particular, but not exclusively, examples of this disclosure concern a hinge for attaching a leaf, such as a door leaf; the leaf, and a leaf system comprising the hinge and the leaf.

BACKGROUND

In buildings which house vulnerable individuals there is often a need to adapt aspects of the buildings to make them safer than conventional buildings. Such individuals are, in many cases, more liable to accidents and, in some case, may be prone to harming themselves intentionally.

One particular example of this is buildings which house individuals with mental health problems. Such individuals can be at risk of attempting to harm or kill themselves, and measures must be taken to minimise the risk of this.

One particular concern is that individuals may attempt to hang themselves. To mitigate the risk of this, individuals at risk are routinely deprived of materials which can be used as ligatures to hang themselves, such as belts, draw cords etc. However, there remains a risk that individuals will be able to obtain or fabricate something, such as by tearing strips of fabric from bedding, using headphone cables or the like. These can be looped around ligature points.

Accordingly a parallel approach of eliminating ligature points in rooms where vulnerable individuals are to be left unsupervised is often undertaken. This involves elimination of any points where a cord or the like can be secured in order to bear the weight of the person trying to hang themselves.

Doors provide a specific challenge in providing an anti-ligature assembly. By their hanging nature there are number of features which provides various ligature points, in particular door handles, hinges, and the top of the door. For example, in a conventional butt hinge door, the top hinge is a ligature point.

This is especially the case with doors which require to self-close, e.g. in line with fire regulations or for security or privacy purposes. Self-closing mechanisms, such as the commonly used face-fixed spring lever arm provide a ligature point.

Various devices have been proposed which aim to reduce or eliminate the presence of ligature points in door assemblies. For example, the following systems are on the market:

- Intastop Anti-ligature Hinge—this is a continuous geared hinge system, which is comparatively complex and challenging to install, and is expensive.
- Dorma ITS96 Concealed Door Closer—this system uses a spring arm which is concealed between the transom and the door when the door is closed, but there is still a possible ligature point around the level and also around the door hinges.
- A continuous (full length) butt hinge (akin to a piano hinge) along the door—such a system avoids ligature points on the hinge, but adding a separate door closer system would add a ligature point. Additionally, a continuous hinge along the full length of a door requires the door and the frame to be well aligned, can be difficult to install correctly, and can add considerable friction, especially if the edge of the frame or door is not perfectly straight.
- A door that is cut shorter than full length, typically with an angled top to encourage any ligature attempt on the top of the door to slide off. The present inventors have identified that this approach does not eliminate ligature risks as one can be created by using the door in the closed position and trapping a bedsheet in the top corner against the door frame.

The present inventors have recognised that all of these prior art systems have associated limitations or problems. Accordingly, the present inventors considered that there remains a need for alternative or improved door assemblies for use in situations where anti-ligature properties are desired.

SUMMARY

According to a first aspect there is provided a hinge. The hinge may comprise an anti-ligature hinge. The hinge may be suitable for a door, such as an anti-ligature door. The hinge may comprise a hinge bracket, such as operatively associable with a support. The hinge may comprise a hinge member, such as operatively associable with a leaf. The hinge member may be connectable to the hinge bracket, with the hinge member being rotatable relative to the hinge bracket about an axis of rotation. The hinge member may be disconnectable from the hinge bracket in response to at least one force threshold. The at least one force threshold may comprise a transverse threshold force comprising a transverse force component transverse to the axis of rotation. In at least some examples, the hinge member may be disconnectable in response to the same transverse threshold force in at least two directions transverse to the axis of rotation. Additionally, or alternatively, the at least one force threshold may comprise an axial threshold force comprising a force component acting along the axis of rotation. In at least some examples, the at least one force threshold may be selected from one or more of: the transverse threshold force; and/or the axial threshold force.

In contrast to prior art hinges, at least some examples of the present disclosure may allow the leaf to be disconnected in response to a similar magnitude of transverse force from at least two directions. For instance, such examples may allow the hinge member to be disconnected in response to a same force from opposite sides of the hinge member (e.g. the threshold force may be the same whether the leaf is pushed inwards or outwards—or whether the leaf is pushed or pulled).

Likewise, in contrast to prior art hinges (such as a conventional butt hinge unresponsive to an axial force, particularly an axial force purely along the axis of rotation), at least some examples of the present disclosure enable disconnection of the hinge member from the hinge bracket in response to an axial force exceeding the axial force threshold. Accordingly, such examples may allow disconnection of the hinge (and leaf) from the hinge bracket in response to a purely axial force acting at the hinge. Similarly, such examples may allow disconnection of the hinge member from the hinge bracket when an axial force threshold is reached, irrespective of whether the hinge is responsive to a transverse force threshold or whether a transverse force threshold has been reached. Particularly where the axis of rotation is vertical, such hinges may be useful in preventing the hinge and/or associated leaf from supporting an excessive weight. The threshold force may be predetermined, such as to accommodate a particular weight of leaf. The threshold force may be selected, such as according to an envisage use and/or risk.

The hinge member may be disconnectable from the hinge bracket in a direction along the axis of rotation. Additionally, or alternatively, the hinge member may be disconnectable from the hinge bracket in a direction transverse to the axis of rotation.

The hinge bracket and the hinge member may be connectable by a coupling arrangement, such as an interengaging coupling arrangement. The hinge member may be connected to the hinge bracket by a hinge biasing means. The hinge biasing means may bias the hinge member towards the hinge bracket. The hinge biasing means may at least partially determine the at least one threshold force. The hinge biasing means may exert a hinge biasing force along the axis of rotation.

The hinge biasing means may be aligned to provide a hinge biasing force parallel to the axis of rotation. In at least some examples, the hinge biasing means may provide the hinge biasing force along the axis of rotation, biasing the hinge member and the hinge bracket into an engaged or connected configuration, such as towards each other.

The hinge biasing means may at least partially connect the hinge member to the hinge bracket. The hinge biasing means may comprise a hinge biasing member. The hinge biasing member may comprise one or more hinge biasing elements, such as a pair of hinge biasing elements associated with the hinge bracket and the hinge member respectively. The hinge biasing means may comprise a magnetic hinge biasing force. For example, at least one of the hinge bracket and/or hinge member may comprise a magnet and the other of the hinge bracket and/or hinge member may comprise a magnetic material to be acted upon by the magnet. The magnetic material may comprise a ferromagnetic material, such as an iron-based material or component. The hinge bracket may comprise the magnet and the hinge member may comprise a non-magnet (ferro)magnetic material, attracted to the hinge bracket's magnet. Thus, the leaf, when disconnected and detached may be magnet-free; such as to reduce a risk of magnet ingestion or use to attach or trap other elements to the disconnected leaf. In at least some examples, both the hinge member and the hinge bracket may comprise a magnet, each magnet exerting a biasing force on the other. The magnet may comprise a permanent magnet. Additionally, or alternatively, the hinge biasing means may comprise a resilient member, such as a spring. The hinge biasing means may comprise the leaf.

The transverse direction may comprise a direction in a plane perpendicular to the axis of rotation. The transverse direction may comprise a direction perpendicular to the axis of rotation. The hinge member may be disconnectable in response to the same transverse threshold force in at least three directions transverse to the axis of rotation. The transverse force threshold may be independent of the direction of transverse force. For example, the hinge member may be disconnectable from the hinge bracket in response to a transverse force threshold being reached, the transverse force threshold being the same for any direction of force in the plane perpendicular to the axis of rotation.

The threshold force may be greater than a force required to open and/or close the leaf, such as in normal use to open and/or close the leaf. The threshold force may be less than a force required to create or support a ligature. The threshold force may be less than a maximum force that can be exercised by a single person on the leaf. For example, the threshold force may less than a pushing force, such as to barge the leaf open. The threshold force may be a component of a non-perpendicular force, such as a component of a tangential force associated with rotation of the leaf about the axis of rotation (e.g. acting to open or close the leaf).

The hinge may be for any leaf, the leaf comprising any movable member, such as any closure. In at least some examples, the support may comprise one or more of: a jamb; a frame; a wall; a post; a lintel. The hinge may be for attaching the movable member, such as a door, shutter, window or the like to the support, such as a wall or frame or the like. The hinge bracket may comprise a fixed device, such as for attachment to a fixed surface (e.g. of a jamb, lintel, frame, wall, or the like). The hinge member may comprise a movable device, such as for attachment to the movable member, such as a movable leaf (e.g. a door leaf, window, shutter, flap, hatch, or the like). The leaf may comprise one or more of: a door leaf, a window leaf, a shutter leaf, a gate leaf, a hatch leaf, a panel; an en-suite door leaf; a door leaf for an internal door; a shower door leaf; a bathroom door leaf; a changing room door leaf; a toilet door leaf; a cubicle door leaf.

The hinge may be configured to eliminate or at least mitigate a risk of an element being trapped in, inserted into or supported by the hinge. The element may comprise a ligature. In at least some examples, the element may comprise a body part, such as a human digit. The hinge may be configured to ensure that there is no more than a maximum clearance, such as between the hinge bracket and the hinge member when connected. The hinge may be configured to define the maximum clearance between parts. The maximum clearance may be sufficiently small to eliminate or at least reduce the risk of element insertion or trapping. The maximum clearance may be applicable to any separation or gap, such as between the hinge bracket and the support; and/or between the hinge member and the hinge bracket; and/or between the leaf and the hinge bracket; and/or between the leaf and the support. The risk of element trapping may be reduced or eliminated by labyrinthine or backing geometry, so as to conceal and/or shield a gap or interface between parts, such as between moving parts (e.g. the hinge member and the hinge bracket).

The coupling arrangement of the hinge member to the hinge bracket may be at least partially rotationally symmetrical, particularly describing an arc of intended usability about the axis of rotation. The rotational symmetry of the coupling arrangement, such as an interface therebetween, may reduce a risk of an element such as a ligature being wedged or trapped by relative rotation between the hinge member and the hinge bracket.

The coupling arrangement may be inter-engaging with the hinge member being at least partially retained and/or located to the hinge bracket by the coupling arrangement. The coupling arrangement may be configured to retain the hinge member to the hinge bracket by providing a resistance to the movement of the hinge member in a direction transverse, such as perpendicular, to the axis of rotation. At least one of the hinge member and/or hinge bracket may comprise a location feature for locating the other of the hinge member or hinge bracket relative to the axis of rotation. The location feature may be configured to centre the hinge member relative to the hinge bracket. The location feature may be for centring the hinge member on the axis of rotation. The location feature may provide at least a contribution to the force threshold, such as providing a mechanical resistance to the disconnection of the hinge member from the hinge bracket in at least some directions transverse to the axis of rotation. The location feature/s may provide a lower mechanical resistance to the disconnection of the hinge member from the hinge bracket in some transverse directions compared to other transverse directions. The coupling arrangement may comprise a plug-and-socket type arrangement. At least one of the hinge member and hinge bracket may comprise a recess for receiving a portion of the other of the hinge member and hinge bracket, such as a corresponding projection or protrusion of the other of the hinge member and hinge bracket. The recess and/or the protrusion may comprise the location feature/s. The location feature/s may comprise a mechanical location feature/s, such as comprising a fit between the corresponding portions of the hinge member and hinge bracket. In at least some examples, each of the hinge member and the hinge bracket may comprise a recess for receiving a portion of the other of the hinge member and the hinge bracket. The hinge member and the hinge bracket may comprise concentrically-arranged location features, such as with a recess located diametrically outside a protrusion (and/or vice versa), at least when the hinge member is coupled to the hinge bracket. The hinge member and the hinge bracket may comprise coaxially-aligned location features, such as along the axis of rotation, at least when the hinge member is coupled to the hinge bracket. The location features be at least partially concentrically arranged around the axis of rotation. At least one of the location features may comprise a swept profile, such as about the axis of rotation. The swept profile may comprise at least a portion of a ring or torus, such as a full ring about 360 degrees. In at least some examples, the location feature may not a fully swept profile, such as comprising a collar extending around 180 degrees or less. The hinge bracket and hinge member may each comprise a corresponding circular location feature for engaging the other. For example, the hinge bracket may comprise a ring-shaped or circular recess for receiving a ring-shaped or circular protrusion, such as a pin, of the hinge member (and/or vice versa). The hinge biasing means may comprise a location feature/s. In at least some examples, the coupling arrangement comprises a mechanical and a magnetic location feature, each assisting in locating the hinge member relative to the axis of rotation and/or the hinge bracket. The magnetic hinge biasing means may comprise a primary location feature, the primary location feature being a dominant location feature relative to the mechanical location feature/s, such as providing a greater locating force at least when the hinge member and hinge bracket are coupled. Alternatively, the mechanical location feature may comprise the primary location feature.

The hinge may comprise a leaf biasing means. The leaf biasing means may comprise a leaf biasing member. In at least some examples, the leaf biasing means may comprise a leaf-closer. The leaf biasing means may bias the leaf towards a rest position, such as a leaf closed position. The hinge biasing means may comprise the leaf biasing means. For example, a magnetic hinge biasing means may exert a magnetic axial force along the axis of rotation to attract the hinge member to the hinge bracket and also exert a magnetic rotational force about the axis of rotation to bias the hinge member to a preferred rotational orientation relative to the hinge bracket, such as corresponding to the leaf's rest position. Additionally, or alternatively, the leaf biasing means may comprise a distinct biasing means. For example, the hinge biasing means may comprise a distinct magnet and/or resilient member, such as a leaf-biasing spring. In at least some examples, the leaf biasing means may comprise a gravity-based biasing means, or component thereof. For example, the hinge may comprise an angled coupling arrangement, such as a helical or part-helical interface, to bias the hinge member under a weight of the leaf to a preferred rotational position about the axis of rotation, such as corresponding to the leaf rest position.

The hinge may be configured to eliminate or reduce hanging points. For example, the hinge may comprise surfaces sloped or directed downwards to ensure a ligature thereon may be guided off the hinge so that the hinge cannot support the ligature.

The hinge may be configured to prevent or at least impede reconnection of the hinge member and the hinge bracket following disconnection. Preventing or impeding reconnection may minimise or obviate a risk of an element such as a ligature being inserted, such as between the hinge member and hinge bracket or between the leaf and the support. Preventing or impeding reconnection may provide an indication of tamper or abuse.

The hinge may require an action or intervention by an authorised user to enable reconnection of the hinge member to the hinge bracket.

The hinge may require resetting prior to reconnection. The hinge may require a key for reconnection of the hinge member and hinge bracket. Reconnection may comprise reattachment. The key may comprise a mechanical key. In at least some examples, a same key may be for a plurality of systems. For example, where a similar hinge is comprised in a plurality of leaf systems, the key may be operable in each of those systems. Additionally, or alternatively, particularly where there are multiple systems co-located, such as a plurality of door-based systems in a building; or a plurality of discrete systems in a room (e.g. for a plurality of doors and/or window/s and/or fixture/s), then the same key may be operable in each of those systems. In at least some examples, the same key may be operable in further systems in addition to the hinge. For example, the key may be a universal key operable in related systems, such as one or more of: a door access key; a barricade reset key; a viewing panel key.

In at least some examples, the hinge member many not be connectable to the hinge bracket without the hinge biasing means, or at least without the hinge biasing means in an active configuration. In such examples, an absence of the hinge biasing means or an inactive configuration of the hinge biasing means may inhibit or prevent reconnection of the hinge member to the hinge bracket. The hinge biasing means may be reconfigurable from the active configuration to the inactive configuration by the disconnection of the hinge member from the hinge bracket. The hinge biasing means may be reconfigurable from the inactive configuration to the active configuration by resetting the hinge biasing means, such as with the key. In at least some examples, disconnecting the hinge member from the hinge bracket displaces the hinge biasing means to an inactive position.

The hinge may comprise a bearing. For example, the hinge bracket may comprise the bearing for guiding the relative rotational movement between the hinge bracket and hinge member. The bearing may be housed at least partially internally or concealed within the hinge. Accordingly, exposure of relatively moving surface may be reduced, such as to reduce a risk of wedging or entrapment.

According to a further aspect, there is provide a leaf system comprising the hinge of any other aspect, example, claim or embodiment; and a leaf, such as the leaf of any other aspect, example, embodiment or claim.

The leaf system may comprise a plurality of hinges. The plurality of hinges may comprise at least a pair of hinges. The pair of hinges may be aligned on the same axis of rotation. In at least some examples, the hinges may comprise similar features. For example, each hinge may comprise a similar hinge biasing means. Each hinge may be configured to release at a threshold force. The threshold force/s of each hinge may be similar. In at least some examples, at least one hinge of the plurality may comprise one or more dissimilar hinge features. For example, each of the hinges of the plurality may comprise a different threshold force/s. The leaf system may comprise a plurality of hinges whereby each hinge may provide a leaf biasing means. In other leaf systems, not all hinges may comprise a leaf biasing means.

In at least some examples, the pair of hinges may be oppositely-oriented. For example, the hinge bracket of a first hinge of the pair may be opposingly oriented, such as with the hinge brackets of the pair facing each other. Particularly in examples where the axis of rotation is a vertical axis, the respective hinges of the pair may be oriented upwards and downwards respectively. Additionally, or alternatively, the plurality of hinges may be oriented in a same direction. For example, at least two hinges of the plurality may be oriented in a similar direction, such as with each hinge bracket facing upwards to be similarly gravity load-bearing.

A single leaf may be supported by the pair of hinges, with the pair of hinges being located at or towards a top and a bottom of the leaf respectively. The leaf may be mounted between the hinges, such as with the leaf being positioned on the axis of rotation so that the axis of rotation passes directly through the leaf, such as through a medial plane of the leaf. Accordingly, the leaf may be bidirectionally rotatable under a similar magnitude of force (e.g. a similar force to move leaf in either rotational direction).

In at least some examples, the leaf system may comprise more than two hinges. For example, at least some leaf systems may comprise three or more hinges aligned along the axis of rotation. The three or more hinges may all be face in a same orientation, such as with each bracket facing upwards. There may be multiple pairs along one axis of rotation. A plurality of hinges or pairs of hinges may be particularly useful for longer and/or heavier doors.

The hinge member may comprise a nib, such as a leaf nib. The leaf may comprise the hinge member. The hinge member may be integrally-formed with the leaf. Alternatively, the hinge member may be mounted, such as permanently-mounted, to the leaf.

The leaf system may be configured for buildings which house vulnerable individuals, such as buildings which house individuals with mental health problems. The leaf system may be configured to prevent or mitigate against individuals harming themselves and/or harming others.

The leaf system may be configured for one or more of: a prison, a jail, a hospital, an asylum.

The leaf system may comprise a self-closing leaf or leafs.

According to a further aspect there is provided a plurality of leaf systems according to any other aspect, example, embodiment or claim. In at least some examples, a pair of leaf systems may be provided. Each leaf system may be associated with a respective leaf. For example, a double-leaf system comprising a pair of leafs may comprise a pair of leaf systems. Each leaf system may comprise at least one hinge or a pair of hinges associated with each leaf.

The leaf may comprise a leaf of a door. The door may comprise an anti-barricade door. The door may comprise a double-action door (also known as a double-swing door), which can open both ways (e.g. inwards and outwards). The door may comprise a saloon-style door. The door leaf may comprise a saloon-style door leaf. The leaf may not protrude or extend axially beyond at least one hinge. In at least some examples the leaf extends axially only between the hinges. The leaf may terminate axially at the hinge. Particularly, where the axis of rotation is vertical, limiting an axial extension of a leaf so that it does not extend vertically above an upper or uppermost hinge may reduce a risk of an element such as a ligature being placed over the leaf and supported by the hinge bracket. In at least some examples, the upper hinge bracket may extend axially above the leaf. Accordingly, an element such as a ligature placed over the hinge bracket may be unsupported by the hinge bracket, with the element being guided downwards onto the leaf.

The leaf may comprise a lightweight leaf. The leaf may be sufficiently lightweight to reduce a risk of use of a (disconnected) leaf as a weapon, barricade, shield or the like. The leaf may be sufficiently lightweight to allow an opening and/or closing force of the leaf to be less than a ligature force or force required to support a ligature. The leaf may be flexible, such as to allow deformation.

The leaf may be axially deformable. The leaf may be axially deformable so as to allow the hinge member of a leaf member mounted between a pair of hinge brackets to displace sufficiently from the corresponding hinge bracket to disconnect. Accordingly, the hinge member may be disconnectable from the hinge bracket under a purely axial force along the axis of rotation.

According to a further aspect there is provided a leaf. The leaf may be the leaf of or for the leaf system of any other aspect, example, embodiment or claim.

The leaf may comprise a door leaf. The door may comprise an anti-barricade door. The leaf may comprise an anti-ligature door leaf. The leaf may be for a double-action door (also known as a double-swing door), which can open both ways (e.g. inwards and outwards). The leaf may comprise a saloon-style door leaf. The leaf may be configured to provide a clearance or opening between the leaf and a frame when in a closed position, such as a clearance above and/or below the leaf. The clearance or opening may be visible, providing at partial sight into or through the frame or doorway even when the leaf is closed. The clearance may be at least 5 cm; at least 10 cm; at least 20 cm respectively; above and/or below the leaf. The door may comprise a privacy door, such as for a bathroom, a restroom, a toilet, a changing room, a dressing room, or the like. The leaf may comprise a quadrilateral or substantially quadrilateral form or structure, with a hanging edge opposite a leading edge of the leaf, with a top edge and a bottom edge respectively extending between the hanging and leading edges. The leaf may define a leaf plane, such as a medial leaf plane, with each edge lying on the plane. The top edge may slope downwards towards the leading edge. The quadrilateral may comprise a rectangle, trapezium, or parallelogram. The leaf may define a D-shaped outline.

The leaf may comprise an anti-weaponisation leaf. The leaf may be configured to prevent or at least mitigate a risk of injury associated with a use of the leaf as a weapon. The leaf may be configured to prevent or mitigate a risk of injury associated with impact with the leaf, particularly where the leaf is loose or detached from its hinge/s or frame. The leaf may be configured to prevent or mitigate against damage to objects or property by the leaf, particularly when the leaf is detached from its frame or hinge/s or frame.

The leaf may comprise a non-uniform stiffness. The leaf may comprise an anisotropic stiffness. The leaf may comprise a varying or varied stiffness extending across the leaf, in the plane of the leaf. The leaf may comprise a non-uniform stiffness in a direction extending between the hanging edge and the leading edge. Additionally, or alternatively, the leaf may comprise a non-uniform stiffness in a direction extending substantially parallel to the hanging and/or leading edge/s. The leaf may comprise a non-uniform stiffness extending in a direction between the top and bottom edges. The leaf may comprise a multi-stiffness leaf, with at least two portions of differing stiffness, such as a first portion comprising a different stiffness from a second portion.

The leaf may comprise at least one flexible portion. The flexible portion may comprise one or more of: a flexible leading edge portion; a flexible top edge portion; a flexible bottom edge portion; and a flexible hanging edge portion. In at least some examples, the leaf may comprise a continuous flexible portion extending continuously around at least portions of the bottom, leading and top edges. The flexible portion/s may be configured to deflect or deform in a direction transverse to the leaf plane. Additionally, or alternatively, the flexible portion/s may be configured to deflect or deform in a direction of or parallel to the leaf plane. The flexible portion may extend uninterrupted around the top, leading and bottom edges. The leaf may comprise a plurality of flexible portions. The flexible portion/s may extend for a substantial portion of a length of the hanging edge, such as a majority of the hanging edge between two connection points. The flexible portion/s may be configured to dampen or cushion an impact in a direction of the leaf plane. The flexible portion may comprise a buffer.

The flexible portion may deform so as to minimise or cap a stress concentration associated with the leaf. For example, the flexible portion may deflect or deform sufficiently so as to prevent or mitigate against injury, such as cutting or internal bleeding. The flexible portion may deform sufficiently to provide a stress concentration below a threshold. The flexible portion may provide for a soft, feathered edge.

Providing such a flexible portion may reduce a risk of injury or damage. For example, a stress concentration associated with an impact or force exerted by the leaf may be reduced or minimised.

The flexible portion may comprise a maximum thickness. In at least some examples, the edge/s may comprise a corresponding maximum thickness. The maximum thickness may comprise 0.15 mm; 0.2 mm; 0.25 mm; 0.3 mm; 0.4 mm; 0.5 mm; 0.7 mm; 1.0 mm; 1.5 mm; or 2.0 mm. Providing a flexible portion's and/or edge/s with a maximum thickness may help ensure that the flexible portion/s and/or edge/s comprise a stiffness below a stiffness threshold and/or a flexibility above a flexibility threshold.

The flexible portion may comprise a minimum thickness. In at least some examples, the edge/s may comprise a corresponding minimum thickness. The minimum thickness may comprise: 0.05 mm; 0.1 mm; 0.15 mm; 0.2 mm; 0.25 mm; 0.3 mm; or 0.5 mm. Ensuring that an edge comprises a minimum thickness may assist in preventing or mitigating use of an edge for damage. For example, particularly where an edge is rounded, then providing a minimum thickness may allow a minimum radius corresponding to half the thickness. Ensuring that the minimum radius can be above a threshold may reduce a risk of the edge being suitable for stress concentrations or cutting, for example reducing a risk of cuts like 'papercuts' such as where the edge is held under tension.

In at least some examples, the edge portion's comprise/s a thickness between maximum and minimum thresholds. Accordingly, the edge portion's may be sufficiently thin to be deformable whilst being sufficiently thick to provide a sufficiently large radius to mitigate against cuts.

The leaf may comprise at least one stiff portion. The stiff portion may be stiff relative to the flexible portion, comprising a substantially greater stiffness than the flexible portion. The stiff portion may comprise a rigid portion. The stiff portion may comprise an increased thickness of the leaf, such as localised increased thickness of the leaf in one or more portion's of the leaf. The increased thickness may be relative to the thickness of the flexible portion/s. The leaf may comprise a plurality of stiff portions. Alternatively, the leaf may comprise a single stiff portion.

The stiff portion may be spaced from one or more of the leaf's edges. In at least some examples, the stiff portion is spaced from the edge's by a minimum spacing. In at least some examples, the minimum spacing may comprise: 2 mm; 5 mm; 10 mm; 25 mm; 50 mm; 70 mm; or 100 mm. The stiff portion may be spaced from the edge/s by the flexible portion/s. In at least some examples, the stiff portion is spaced from each of the top, leading and hanging edges by a flexible portion covering a spacing of at least around 50 mm to around 100 mm. The flexible portion may comprise a border around at least a part of the stiff portion, particularly when the leaf is hung. The border may comprise a dampening buffer, configured to reduce a stress concentration associated with an impact with or of the leaf in a direction of the leaf plane, such as if the leaf is attempted to be used as a weapon.

The stiff portion may comprise a reinforcement. The stiff portion may be formed of a similar material to the flexible portion/s. The stiff portion may comprise a greater thickness than the flexible portion. The stiff portion may comprise a greater thickness of the material of the flexible portion. The stiff portion may comprise a uniform thickness, such as formed by a plurality of layers of sheet material. The flexible portion may comprise a uniform thickness, such as performed by fewer layers of sheet material than that the stiff portion.

The stiff portion may comprise a spine. The spine may extend between two connection points of the leaf, such as a pair of hinge areas or nibs of the leaf. The spine may extend continuously between the two connection points. The leaf may comprise a gap separating at least a portion of the spine from the hanging edge. The hanging edge may be coincident with or parallel to a rotation axis of the leaf, such as defined by a hinge/s. At least a portion of the spine may be spaced from the hanging edge. At least a portion of the spine may be spaced from the axis of rotation. At least a portion of the spine may be separated from the hanging edge by a flexible portion. In at least some examples, a substantial majority of the spine may be spaced from the hanging edge.

The stiff portion may be configured to allow hinged opening and/or closing of the leaf. The stiff portion may be configured to enable the leaf to hinge before deforming beyond a deformation threshold. For example, the stiff portion may allow the leaf to open by rotation about its hinge axis under a force or moment applied by a user's hand to the leaf. Accordingly, the stiff portion may translate a pushing force to the hinges reducing the deflection of the leaf in comparison to pushing on only a flexible portion. According the leaf may be configured to maintain a more familiar feeling, which may be important for impaired users.

The stiff portion may comprise a user contact point. The user contact point may comprise an area or portion of the leaf intended for interaction with a user, such as for a user to push the leaf to open. The stiff portion may connect the user contact point with at least one of the connection points, such as one or both of the leaf's hinges. In at least some examples, the stiff portion comprises a spine extending longitudinally vertically between the hinges and laterally towards the user contact point. The user contact point may be located towards the leading edge, such as closer to the leading edge than to the hanging edge. The user contact point may be located more towards the top edge than the bottom edge. Alternatively, the user contact point may be located more towards the bottom edge than the top edge. In at least some examples, the user contact point extends equally towards the bottom and top edges. The user contact point may be configured to transmit torque from contact with a user to the leaf's hinge/s. The user contact point may be configured to provide feedback such as reassurance to a user. The user contact point may be configured to be accessible by walking and/or wheelchair users. The leaf may comprise an axial stiffness to operate (turn) the hinge, which may comprise a spring return (e.g. self-closing). The leaf may be configured to hinge open under a force of 2-4N applied at the user contact point. The user contact point may comprise a spacing from the leaf hinge axis of around 450 mm. The stiff portion may be configured to prevent the leaf deflecting back on itself and presenting a consistent physical barrier and hindering wheelchair access, etc.

The stiff portion may comprise a reinforcement. The stiff portion may be configured to prevent or inhibit deformation of the leaf, such as to prevent or inhibit rolling of the leaf (e.g. into a tube).

The stiff portion may comprise a maximum thickness. In at least some examples, the stiff portion maximum thickness may comprise 0.5 mm; 0.7 mm; 1.0 mm; 1.5 mm; 1.7 mm; 2.0 mm; or 3.0 mm. Providing a stiff portion/s with a maximum thickness may help ensure that the leaf as such comprises an overall stiffness below an overall stiffness threshold and/or an overall flexibility above an overall flexibility threshold. Accordingly, the leaf as a whole may be sufficiently unwieldy as to reduce a risk of weaponization. Providing a maximum thickness may assist in keeping an overall weight of the leaf below a weight threshold. The weight threshold may mitigate against the leaf being used as a weapon.

The stiff portion may comprise a minimum thickness. In at least some examples, the stiff portion minimum thickness may comprise: 0.5 mm; 0.7 mm; 1.0 mm; 1.5 mm; 1.7 mm; 2.0 mm; or 3.0 mm. Ensuring that the stiff portion comprises a minimum thickness may ensure that the minimum stiffness threshold is reached.

The leaf may comprise a flexural modulus of less than 20 GPa; less than 10 GPa; less than 7 GPa; less than 5 GPa; or less than 2 GPa. The flexural modulus may comprise a ratio of stress to strain. The leaf may comprise a first leaf material with a flexural modulus of less than 20 GPa; less than 10 GPa; less than 7 GPa; less than 5 GPa; or less than 2 GPa. In at least some examples, the first leaf material comprises a flexural modulus of around 1.5 GPa. The leaf may comprise a flexural modulus of more than 0.2 GPa; 0.5 GPa; 1.0 GPa; or 1.5 GPa. The first leaf material may comprise a flexural modulus of more than 0.2 GPa; 0.5 GPa; 1.0 GPa; or 1.5 GPa. In at least some examples, the leaf comprises a flexural modulus of around 1.5 GPa. In at least some examples, the first leaf material comprises a flexural modulus of around 1.5 GPa.

The leaf may comprise a flexural strength of less than 200 MPa; less than 100 MPa; less than 70 MPa; or less than 50 MPa. The flexural strength may comprise a stress before yielding. The first leaf material may comprise a flexural strength of less than 200 MPa; less than 100 MPa; less than 70 MPa; or less than 50 MPa. The leaf may comprise a flexural strength of more than 10 MPa; more than 20 MPa; or more than 40 MPa. In at least some examples, the leaf comprises a flexural strength of around 40 MPa. In at least some examples, the first leaf material comprises a flexural strength of around 40 MPa.

The first leaf material may comprise a polymer. The polymer may comprise polypropylene. In at least some examples, the flexible portion/s may comprise the first leaf material. Additionally, or alternatively, the stiff portion/s may comprise the first leaf material.

In at least some examples, the leaf comprises variations in thickness corresponding to the flexible and stiff portions. For example, the leaf may comprise a same first leaf material for the stiff and flexible portions with the variations in stiffness being provided by variations in thickness.

The leaf may be formed of layers of the first leaf material. The reinforcement for the stiff portion/s may comprise an additional layer/s of the first leaf material relative to the flexible portion/s. The layers may be bonded, such as by adhesive, fusion, heat treatment, welding or the like.

In at least some examples, the leaf may be configured to deform under a load applied downwards, such as a load applied downwards from the top of the leaf. The leaf may be configured to deform sufficiently to allow or enable disconnection from or at the hinge, such as the top hinge. The leaf may be configured to deform or deflect by bowing in the middle of the leaf (e.g. in one or either outwards direction relative to the plane of the leaf). (The leaf will deform in this manner under a load of 0.3 kg when not connected to the pivot) The actual disconnecting force of the nib to the pivot is 3 kg.

The leaf may be configured to interact with a hinge to allow the nib to slip outwards unimpeded due to a chamfer at the nib interaction of the leaf at the hinge. The leaf may be configured to allow twisting/buckling at the bottom of the leaf to enable the bottom nib to slip under a load of 0.5 kg.

The leaf may comprise at least one flexible corner. For example, where the leading edge meets the top and/or bottom edge/s, the corner may comprise a flexible portion.

The leaf edge corners may comprise a minimum radius, such as a minimum radius in or parallel to the leaf plane. In at least some examples, the edge corners comprise a minimum radius of at least: 2 mm; 5 mm; 10 mm; 15 mm; 20 mm; 30 mm; 50 mm; or 100 mm. Providing the leaf edge corners with a minimum radius may reduce a risk of injury or damage.

The leaf may comprise internal corners within the leaf. The internal corners may be defined by the stiff portion/s, such as the reinforcement/s. The internal corners may comprise a minimum radius. The internal corner minimum radius may be at least 1 mm; 2 mm; 5 mm; 10 mm; 15 mm; 20 mm; 30 mm; 50 mm; or 100 mm. Providing the internal corner/s with a minimum radius may reduce a risk of peeling.

The leaf may comprise a non-sealing door. The flexible portion/s may comprise non-sealing portion/s.

The leaf may comprise a handle-less leaf. In at least some examples, the leaf may be devoid of surface features, such as surface protrusions, fixings or fastenings—other than for hanging or hinging purposes. The leaf may devoid of surface features on either or both planar face/s.

According to a further aspect there is provided a method of manufacturing a leaf, such as the leaf of any other aspect, example, embodiment or claim. The method may comprise providing the leaf with a flexible portion's and a stiff portion/s.

The method may comprise forming the leaf from a plurality of layers of a first leaf material. The first leaf material may comprise a sheet material. The method may comprise using the plurality of layers to create a portion's of increase thickness or stiffness. The plurality of layers may be of similar thickness. Additionally, or alternatively the plurality of layers may comprise layers of different thicknesses.

In at least some examples, the method comprises assembling at least two layers of a similar sheet material to provide a portion's of effectively at least double stiffness. In at least some examples, the plurality of layers may be provided by a single sheet member. For example, the sheet member may be folded to provide a portion's of increased thickness. The method may comprise including the fold as a portion of the finished leaf. Alternatively, the method may comprise removing at least a portion of the fold from the leaf, such that the finished leaf does not comprise the fold or not the complete fold.

The method may comprise joining the plurality of layers. Joining the plurality of layers may comprise: bonding; adhesive; tapping. In at least some examples, the method comprises joining the plurality of layers planarly to each other using an adhesive layer therebetween. The adhesive layer may comprise an adhesive tape, such as an industrial adhesive tape with a thickness of around 0.05 mm.

The method may comprise a post-forming process. In at least some examples, the method may comprise one or more post-forming process of: cutting one or more exterior edges of the leaf; chamfering; polishing; printing; stickering; and/or finishing.

According to a further aspect there is provided a method of hinging a leaf. The method may comprise operatively associating a hinge bracket with a support. The method may comprise operatively associating a hinge member with the leaf. The method may comprise connecting the hinge member to the hinge bracket, with the hinge member being rotatable relative to the hinge bracket about an axis of rotation. The method may comprise disconnecting the hinge member from the hinge bracket in response to at least one force threshold.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to the other aspects without the need to explicitly and unnecessarily list those various combinations and permutations here (e.g. the device of one aspect may comprise features of any other aspect). Optional features as recited in respect of a method may be additionally applicable to an apparatus or device; and vice versa.

In addition, corresponding means for performing one or more of the discussed functions are also within the present disclosure.

It will be appreciated that one or more embodiments/aspects may be useful in at least hinging a leaf.

The above summary is intended to be merely exemplary and non-limiting.

Various respective aspects and features of the present disclosure are defined in the appended claims.

It may be an aim of certain embodiments of the present disclosure to solve, mitigate or obviate, at least partly, at least one of the problems and/or disadvantages associated with the prior art. Certain embodiments or examples may aim to provide at least one of the advantages described herein.

BRIEF DESCRIPTION OF THE DRAWINGS

These and other aspects of the present invention will now be described, by way of example only, with reference to the accompanying drawings, in which.

DETAILED DESCRIPTION

Figure 2:
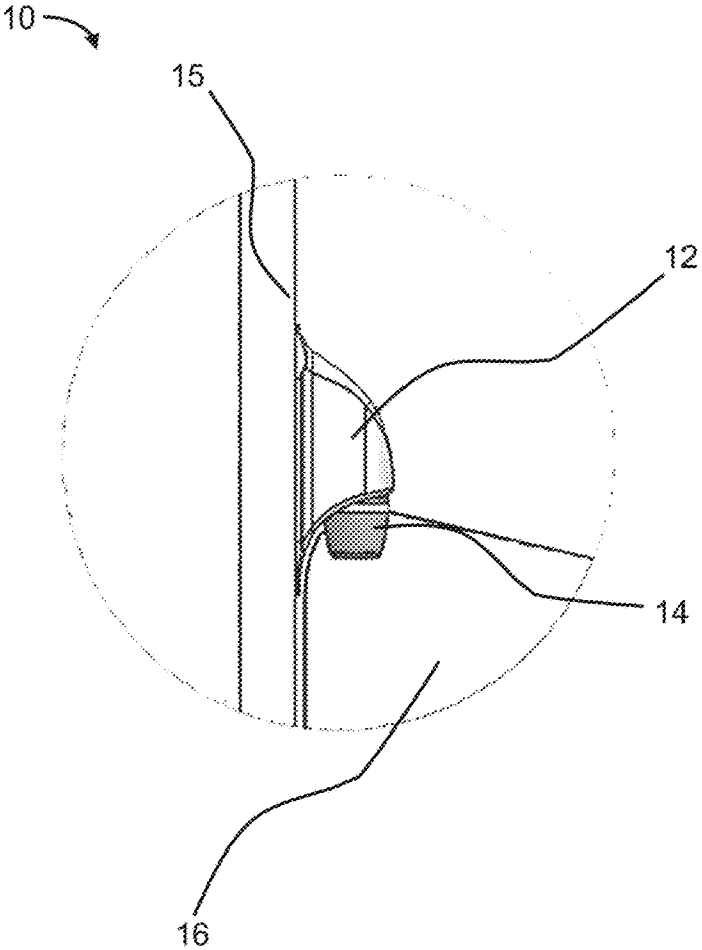
FIG. 2 shows a detail view of the hinge of FIG. 1.
Figure 1:
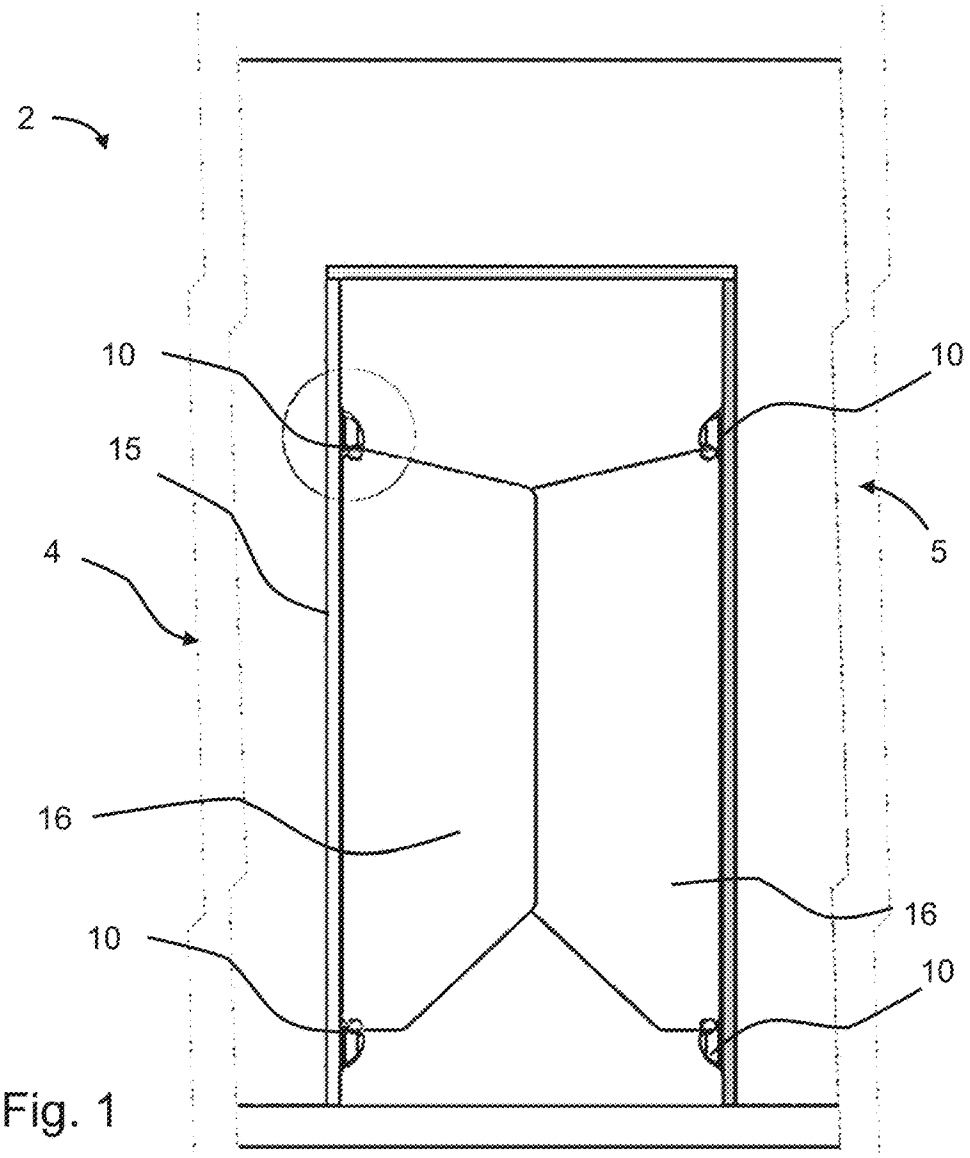
FIG. 1 is a front view of an example doorway showing a first example of a leaf system with a hinge according to this disclosure.

Referring to FIG. 1 there is shown a front view of an example doorway 2 showing a first example of a leaf system 5 with a hinge 10 according to this disclosure. Here, the hinge 10 comprises an anti-ligature hinge 10 for an anti-ligature door 4. FIG. 2 shows a detail view of the hinge 10 of FIG. 1. The hinge 10 comprises a hinge bracket 12, operatively associable with a support 15, shown here as a doorframe. The hinge 10 comprises a hinge member 14 operatively associable with a leaf 16. The hinge member 14 is connectable to the hinge bracket 12, with the hinge member 14 being rotatable relative to the hinge bracket 12 about an axis of rotation 20. The hinge member 14 is disconnectable from the hinge bracket 12 in response to at least one force threshold. The at least one force threshold comprises a transverse threshold force comprising a transverse force component transverse to the axis of rotation 20. Here, the hinge member 14 is disconnectable in response to the same transverse threshold force in at least two directions transverse to the axis of rotation 20, as described in detail below. Additionally here, the at least one force threshold also comprises an axial threshold force comprising a force component acting along the axis of rotation 20.

In contrast to prior art hinges, the example hinge 10 here allows the leaf 16 to be disconnected in response to a similar magnitude of transverse force from at least two directions. For instance, the hinge 10 allows the hinge member 14 to be disconnected in response to a same force from opposite sides of the hinge member 14 (e.g. the threshold force is the same whether the leaf 16 is pushed inwards or outwards—or whether the leaf 16 is pushed or pulled).

Likewise, in contrast to prior art hinges (such as a conventional butt hinge unresponsive to an axial force, particularly an axial force purely along the axis of rotation 20), the hinge 10 here enables disconnection of the hinge member 14 from the hinge bracket 12 in response to an axial force exceeding the axial force threshold. Accordingly, the hinge 10 here allows disconnection of the hinge member 14 (and leaf 16) from the hinge bracket 12 in response to a purely axial force acting at the hinge 10. Similarly, the hinge 10 here allows disconnection of the hinge member 14 from the hinge bracket 12 when an axial force threshold is reached, irrespective of whether a transverse force threshold has been reached. Particularly where the axis of rotation 20 is vertical as shown here, the hinge 10 is useful in preventing the hinge 10 or associated leaf 16 from supporting an excessive weight.

Figure 5:
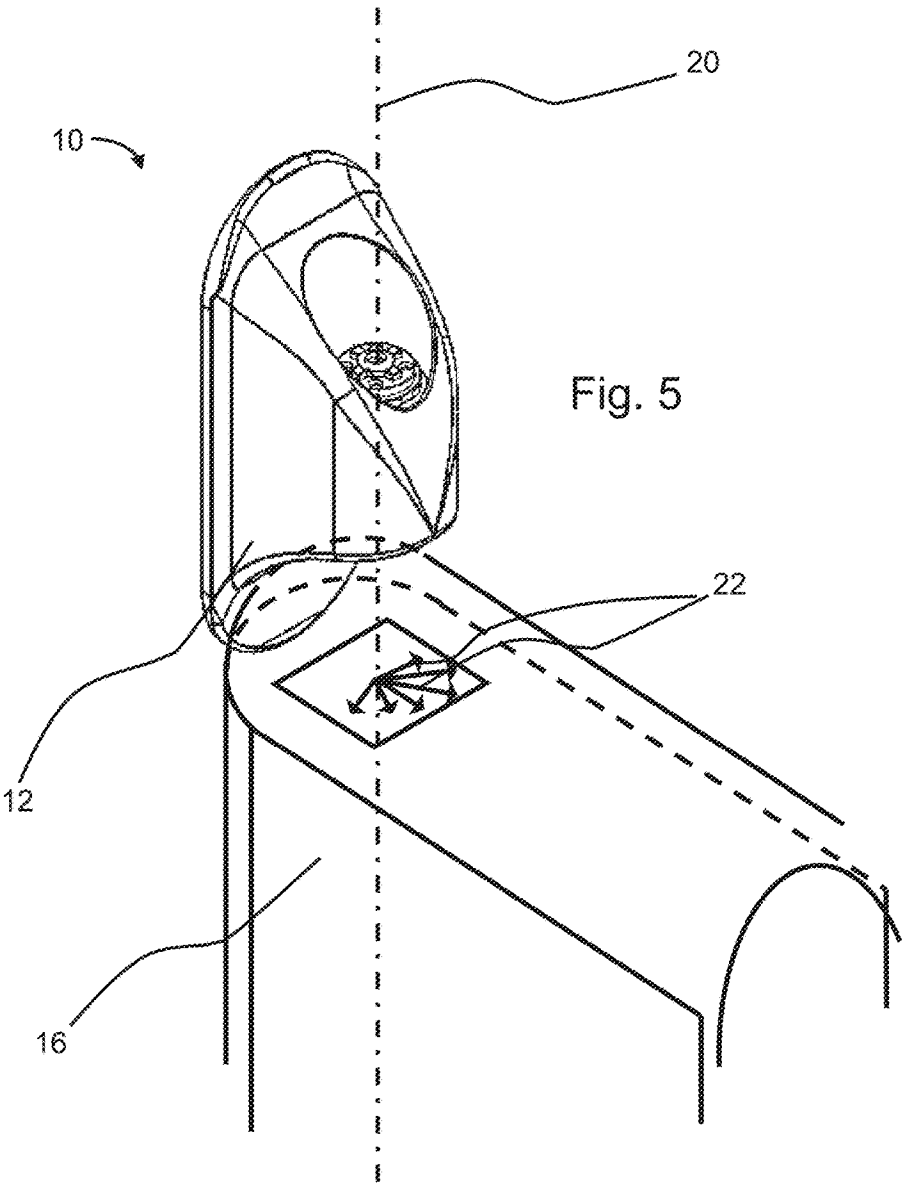
FIG. 5 shows an isometric view of the hinge bracket of FIG. 3, with a portion of a leaf schematically illustrated.
Figure 3:
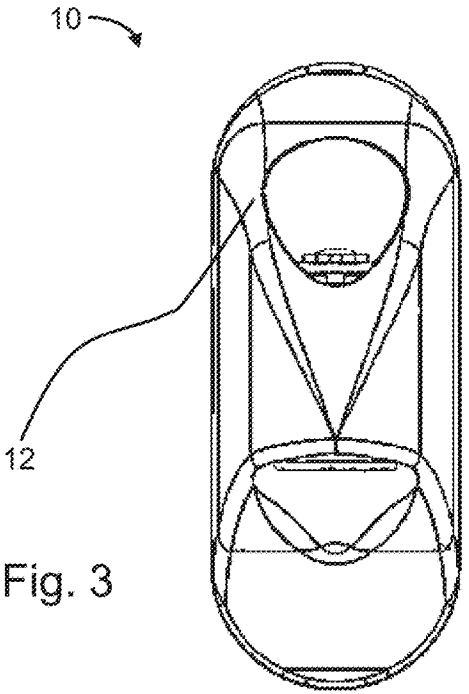
FIG. 3 shows a front view of a hinge bracket of the hinge of FIG. 1.
Figure 4:
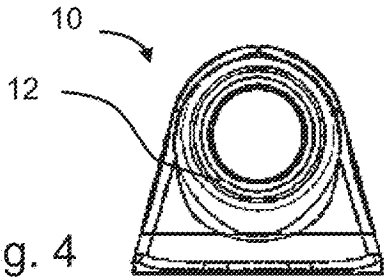
FIG. 4 shows an end view of the hinge bracket of FIG. 3.

Reference is now made to FIGS. 3, 4, and 5 each showing the hinge bracket 12 of FIG. 1 in respective front, end and isometric views. FIG. 5 additionally shows a schematic portion of the leaf 1. As can be appreciated from FIG. 3 in particular, the hinge member 14 is disconnectable from the hinge bracket 12 in a direction along the axis of rotation 20-here in a downwards, direction as shown. Additionally, the hinge member 14 is disconnectable from the hinge bracket 12 in a direction transverse to the axis of rotation 20, as illustrated by the arrows 22 in FIG. 3. The hinge 10 is configured to eliminate or reduce hanging points. For example, the hinge 10 comprises surfaces sloped or directed downwards to ensure a ligature thereon is guided off the hinge 10 so that the hinge 10 cannot support the ligature.

The transverse direction comprises a direction in a plane perpendicular to the axis of rotation 20. The transverse direction comprises a direction perpendicular to the axis of rotation 20. The hinge member 14 is disconnectable in response to the same transverse threshold force in at least three directions transverse to the axis of rotation 20. The transverse force threshold is independent of the direction of transverse force. For example, the hinge member 14 is disconnectable from the hinge bracket 12 in response to a transverse force threshold being reached, the transverse force threshold being the same for any direction of force in the plane perpendicular to the axis of rotation 20.

The threshold force is greater than a force required to open and/or close the leaf 16, such as in normal use to open and/or close the leaf 16. The threshold force is less than a force required to create or support a ligature. The threshold force is less than a maximum force that can be exercised by a single person on the leaf 16. For example, the threshold force may less than a pushing force, such as to barge the leaf 16 open. The threshold force is a component of a non-perpendicular force, such as a component of a tangential force associated with rotation of the leaf 16 about the axis of rotation 20 (e.g. acting to open or close the leaf 16).

The hinge 10 is for any leaf 16, the leaf 16 comprising any movable member, such as any closure. In at least some examples, the support comprises one or more of: a jamb; a frame; a wall; a post; a lintel. The hinge 10 is for attaching the movable member, such as a door, shutter, window or the like to the support, such as a wall or frame or the like. The hinge bracket 12 comprises a fixed device, such as for attachment to a fixed surface (e.g. of a jamb, lintel, frame, wall, or the like). The hinge member 14 comprises a movable device, such as for attachment to the movable member, such as a movable leaf 16 (e.g. a door leaf 16, window, shutter, flap, hatch, or the like). The leaf 16 comprises one or more of: a door leaf 16, a window leaf 16, a shutter leaf 16, a gate leaf 16, a hatch leaf 16, a panel.

Here, the leaf system 5 comprises a plurality of hinges 10 with a pair of hinges 10 associated with each single leaf 16. Each hinge 10 of the pair of hinges 10 is aligned on the same axis of rotation 20. Here, the hinges 10 comprise similar features. For example, each hinge 10 is configured to release at a similar threshold force. Here, the pair of hinges 10 is oppositely-oriented. For example, the hinge bracket 12 of a first hinge 10 of the pair is opposingly oriented, such as with the hinge brackets 12 of the pair facing each other. Here, where the axis of rotation 20 is a vertical axis, the respective hinge 10 of the pair is oriented upwards and downwards respectively. A single leaf 16 is supported by the pair of hinges 10, with the pair of hinges 10 being located at or towards a top and a bottom of the leaf 16 respectively. The leaf 16 is mounted between the hinges 10, with the leaf 16 being positioned on the axis of rotation 20 so that the axis of rotation 20 passes directly through the leaf 16, here through a medial plane of the leaf 16 (see also FIG. 5). Accordingly, the leaf 16 is bidirectionally rotatable under a similar magnitude of force (e.g. a similar force to move the leaf 16 in either rotational direction). Here, the hinge member 14 comprises a leaf nib and door mount, with the hinge member 14 being permanently-mounted to the leaf 16. In other examples, the hinge member 14 is integrally-formed with the leaf.

As shown in FIG. 1, a pair of leaf systems 5 is provided, each leaf system 5 being associated with a respective leaf 16. The double-leaf system 5 comprises a pair of leafs 16 with a pair of hinges 10 associated with each leaf 16, for an anti-barricade double-action door 4, which can open both ways (e.g. inwards and outwards). Here, the door 4 comprises a saloon-style door. Each door leaf 16 comprises a saloon-style door leaf 16 that does not protrude or extend axially beyond either hinge 10, the leaf extending axially only between the hinges 10. The leafs 16 here terminate axially at each hinge 10. Here, where the axis of rotation 20 is vertical, limiting an axial extension of a leaf so that it does not extend vertically above an upper or uppermost hinge 10 reduces a risk of an element such as a ligature being placed over the leaf 16 and supported by the hinge bracket 12. As can be seen clearly in FIG. 2, the upper hinge bracket 12 extends axially above the leaf 16. Accordingly, an element such as a ligature placed over the hinge bracket 12 is unsupported by the hinge bracket 12, with the element being guided downwards onto the leaf 16 (which can then be disconnected from the bracket 12, preventing support of a ligature).

Here, the leaf 16 comprises a lightweight leaf. The leaf 16 is sufficiently lightweight to reduce a risk of use of a (disconnected) leaf as a weapon, barricade, shield or the like.

The leaf 16 is sufficiently lightweight to allow an opening and closing force of the leaf 16 to be less than a ligature force or force required to support a ligature. The leaf 16 is flexible, such as to allow deformation (e.g. if loaded or used as a weapon) and reduces the chance of being able to self-harm or create ligature points as it is not possible to jar the leaf 16 against body parts or other objects when connected to the hinge bracket 12.

Figure 8:
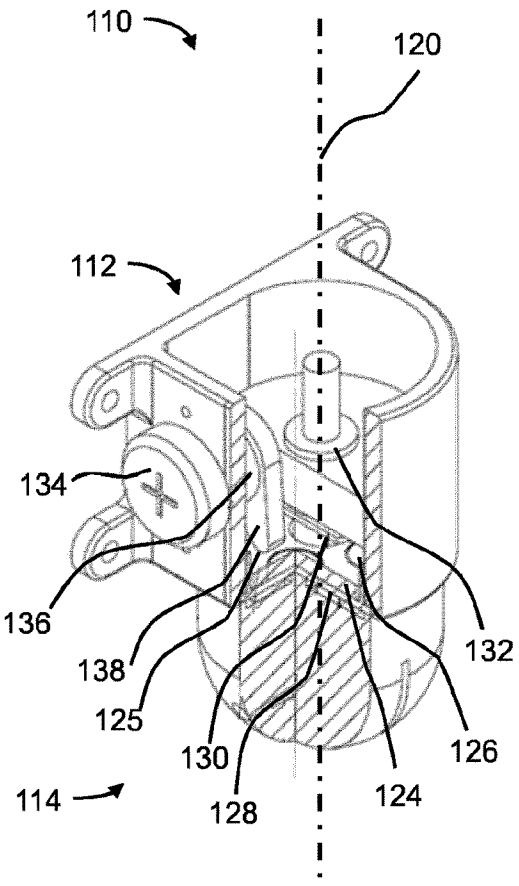
FIG. 8 shows the hinge of FIG. 6 in a reconnection configuration.
Figure 7:
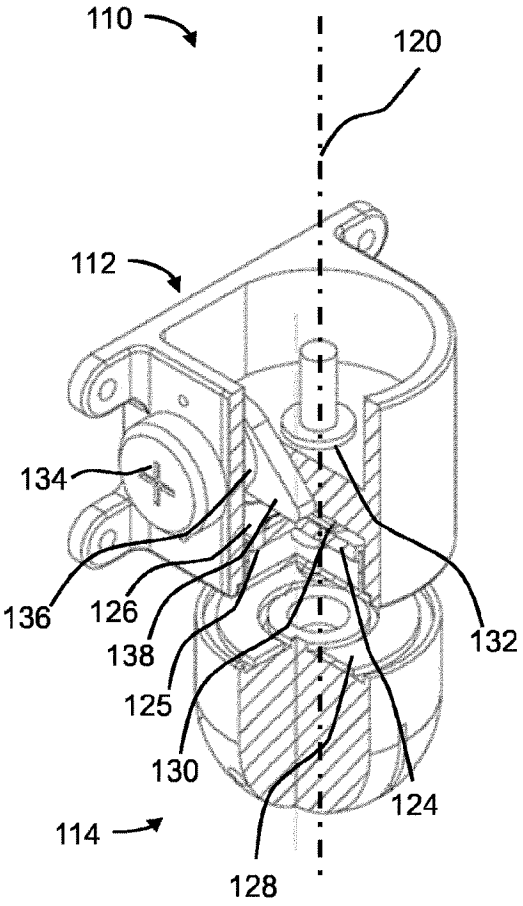
FIG. 7 shows the hinge of FIG. 6 in a disconnected configuration.
Figure 6:
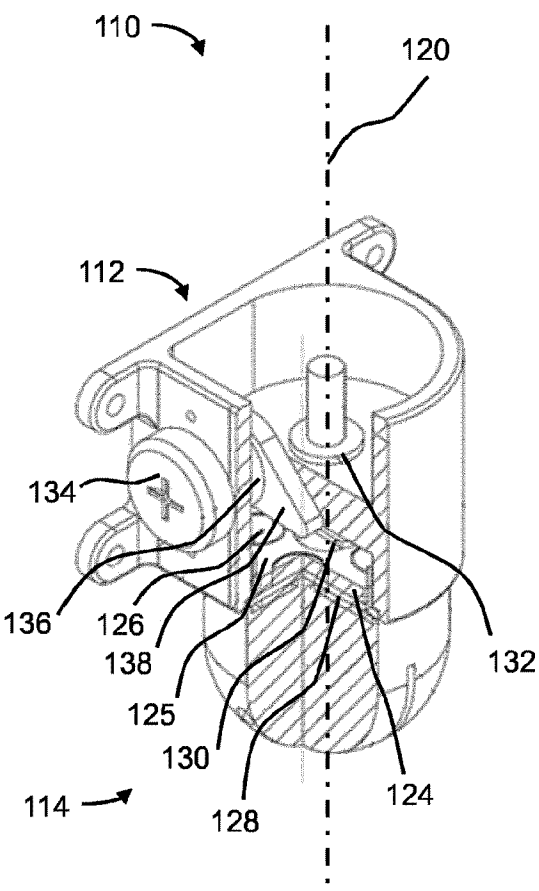
FIG. 6 shows an isometric view of a further example of a hinge according to the disclosure, the hinge shown in partial cross-section with the hinge in a normal use configuration.

Referring now to FIGS. 6, 7 and 8, there are shown isometric partial cross-sectional views of a further example of a hinge 110 in respective normal use, disconnected and reconnection configurations. The hinge 110 is generally similar to that shown in FIG. 1, with similar features referenced by similar reference numerals, incremented by 100. Accordingly, the hinge 110 of FIG. 6 comprises a hinge bracket 112 and a hinge member 114. For conciseness, not all references are repeated.

The hinge bracket 112 and the hinge member 114 is connectable by a coupling arrangement, such as an interengaging coupling arrangement. The hinge member 114 is connected to the hinge bracket 112 by a hinge biasing means 124. The hinge biasing means 124 biases the hinge member 114 towards the hinge bracket 112. Here, the hinge biasing means 124 at least partially determines the at least one threshold force. The hinge biasing means 124 exerts a hinge 110 biasing force along the axis of rotation 120.

The hinge biasing means 124 is aligned to provide a hinge 110 biasing force parallel to the axis of rotation 120, here along the axis of rotation 120, biasing the hinge member 114 and the hinge bracket 112 towards each other into an engaged or connected configuration, such as shown in FIG. 6.

The hinge biasing means 124 at least partially connects the hinge member 114 to the hinge bracket 112. The hinge biasing means 124 comprises a hinge 110 biasing member with a plurality of biasing elements in the form of permanent magnets 126 within the hinge bracket 112. Here, the hinge member 114 comprises a magnetic material in the form of a ferromagnetic washer 128 to be acted upon by the magnets 126.

The hinge 110 is configured to eliminate or at least mitigate a risk of an element such as a ligature being trapped in, inserted into or supported by the hinge 110. The hinge 110 is configured to ensure that there is no more than a maximum clearance, such as between the hinge bracket 112 and the hinge member 114 when connected. The hinge 110 is configured to define the maximum clearance between parts. The maximum clearance is sufficiently small to eliminate or at least reduce the risk of element insertion or trapping. The maximum clearance is applicable to any separation or gap, such as between the hinge bracket 112 and the support; and/or between the hinge member 114 and the hinge bracket 112; and/or between the leaf and the hinge bracket 112; and/or between the leaf and the support. The risk of an element trapping is reduced or eliminated by labyrinthine or backing geometry, so as to conceal and/or shield a gap or interface between parts, such as between moving parts (e.g. of the hinge member 114 and the hinge bracket 112).

As can be appreciated from FIG. 7 in particular, the coupling arrangement of the hinge member 114 to the hinge bracket 112 is at least partially rotationally symmetrical, describing an arc of intended usability about the axis of rotation 120. The rotational symmetry of the coupling arrangement, such as an interface therebetween, reduces a risk of an element such as a ligature being wedged or trapped by relative rotation between the hinge member 114 and the hinge bracket 112.

As with the hinge 10 of FIG. 1, the hinge member 114 is disconnected and detached from the hinge bracket 112 when a force threshold is reached, as shown in FIG. 7. As can be seen, the hinge member 114 has been displaced downwards from the hinge bracket 112, such as in response to an excessive force acting on an associated leaf (not shown). As can be seen when comparing FIG. 7 to FIG. 6, the hinge biasing means 124 has been reconfigured from an active configuration for normal use in FIG. 6 to an inactive configuration in FIG. 7, caused by the removal of the hinge member 114. Here, a biasing member 125 holding the magnets 126 has been drawn axially upwards by a magnetic force of attraction between the hinge biasing means 124 and a magnetic material in the form of a ferromagnetic washer 130 in the hinge bracket 112. The magnetic force between the magnets 126 and the washer 130 in the hinge bracket 112 has become stronger than the magnetic force between the magnets 126 and the ferromagnetic washer 128 in the hinge member 114 when the hinge member 114 has become displaced to the position of FIG. 7.

The hinge 110 is configured to prevent or at least impede reconnection of the hinge member 114 and the hinge bracket 112 following disconnection. Preventing or impeding reconnection may minimise or obviate a risk of an element such as a ligature being inserted, such as between the hinge member 114 and hinge bracket 112 or between the leaf and the support. Preventing or impeding reconnection can provide an indication of tamper or abuse. For example, this gives staff a clear indication that the door has been tampered with as it will be detached. This can inform risk assessments for service users. The hinge biasing means 124 is reconfigurable from an active configuration of FIG. 6 to an inactive configuration of FIG. 7 by the disconnection of the hinge member 114 from the hinge bracket 112.

The hinge 110 requires an action or intervention by an authorised user, such as a member of staff, to enable reconnection of the hinge member 114 to the hinge bracket 112. The hinge 110 requires resetting prior to reconnection. The hinge 110 requires a key for reconnection of the hinge member 114 and hinge bracket 112. Here the key (not shown) comprises a mechanical key. As shown in FIG. 7, when detached it is not possible to reattach the leaf 116 without input of the key. Offering the leaf 116 back up to the hinge bracket 112 will result in no action: the hinge member 114 cannot be brought sufficiently close to the magnets 126 for the magnets to exert a required hinge biasing force on the hinge member 114. Accordingly, the hinge member 114 cannot be reconnected and the leaf 116 remains detached. As can be seen in FIG. 7, the hinge member 114 is not be connectable to the hinge bracket 112 without the hinge biasing means 124 being in the active configuration. The inactive configuration of the hinge biasing means 124 prevents reconnection of the hinge member 114 to the hinge bracket 112. This gives staff a clear indication that the door has been tampered with as it will be detached. This can inform risk assessments for service users.

The hinge biasing means 124 is reconfigurable from the inactive configuration to the active configuration by resetting the hinge biasing means 124, with the key. As shown in FIG. 7, disconnecting the hinge member 114 from the hinge bracket 112 displaces the hinge biasing means 124 to the inactive position. The key is inserted via a key escutcheon 134 into a lock barrel 136. As the key is turned, the lock barrel 136 and an associated cam 138 rotate and mechanically push the magnets 126 downwards. In doing so, the magnets 126 are drawn away from the washer 130 in the hinge bracket 112 and lessens the magnetic attraction. By offering up the hinge member 114 (attached to the leaf), the magnets 126 drop down favouring the magnetic pull of the washer 128 of the hinge member 114. It will be appreciated, that the hinge member 114 must be reconnected whilst the hinge 110 is in the reconnection configuration of FIG. 8 (i.e. with the key present). Once the key is removed (after rotating back to position of FIG. 6 to allow key removal), the hinge member 114 can no longer be reconnected (in an absence of attraction to the washer 128 of the hinge member 114, the magnets 126 return to the inactive position of FIG. 7).

The hinge 110 further comprises a bearing 132 in the form of a bushing. The bearing 132 guides the relative rotational movement between the hinge bracket 112 and hinge member 114. The bearing 132 is housed at least partially internally and concealed within the hinge bracket 112. Accordingly, exposure of relatively moving surfaces is reduced, such as to reduce a risk of wedging or entrapment.

Figures 9, 10, 11:
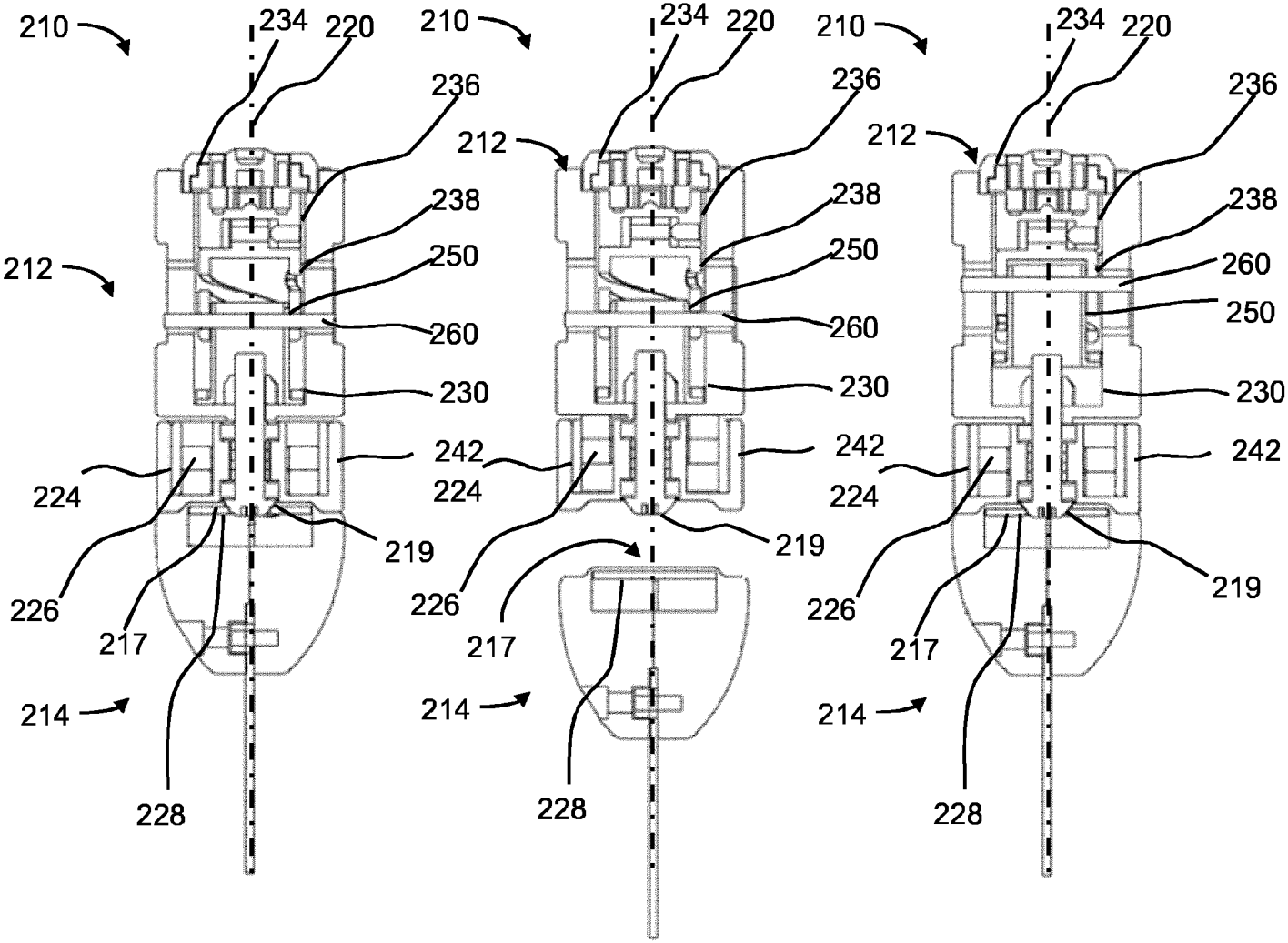
FIG. 9 shows a view of a further example of a hinge according to the disclosure, the hinge shown in partial cross-section with the hinge in a normal use configuration.
FIG. 10 shows the hinge of FIG. 9 in a disconnected configuration.
FIG. 11 shows the hinge of FIG. 9 in a reconnection configuration.

Referring now to FIGS. 9, 10 and 11, there are shown partial cross-sectional views of a further example of a hinge 210 in respective normal use, disconnected and reconnection configurations. The hinge 210 is generally similar to that shown in FIGS. 6, 7 and 8, with similar features referenced by similar reference numerals, incremented by 100. Accordingly, the hinge 210 of FIG. 9 comprises a hinge bracket 212 and a hinge member 214. For conciseness, not all references are repeated.

Again here the hinge member 214 is connected to the hinge bracket 212 and held in place by a magnetic pull between a magnet 226 (here a ring magnet) in the hinge bracket 212 and a ferromagnetic washer 228, as shown in FIG. 9. The hinge bracket comprises a sleeve 250 for engaging the magnet 226; and a pivot housing 242 that is rotatable with the hinge member 214 relative to an upper body of the hinge bracket 212.

As with the hinge 110 of FIG. 7, the hinge member 214 is disconnected and detached from the hinge bracket 212 when a force threshold is reached, as shown in FIG. 10. As can be seen, the hinge member 214 has been displaced downwards from the hinge bracket 212, such as in response to an excessive force acting on an associated leaf (not shown). As can be seen when comparing FIG. 10 to FIG. 9, the hinge biasing means 224 has been reconfigured from an active configuration for normal use in FIG. 9 to an inactive configuration in FIG. 10, caused by the removal of the hinge member 214. Here, the ring magnet 226 has been drawn axially upwards by a magnetic force of attraction between the hinge biasing means 224 and a magnetic material in the form of a ferromagnetic washer 230 in the hinge bracket 212. The magnetic force between the magnet 226 and the washer 230 in the hinge bracket 212 has become stronger than the magnetic force between the magnet 226 and the ferromagnetic washer 228 in the hinge member 214 when the hinge member 214 has become displaced to the position of FIG. 10.

As with FIGS. 6 to 8, the coupling arrangement is inter-engaging, here with the hinge member 214 being at least partially retained and located to the hinge bracket 212 by the coupling arrangement. The coupling arrangement is configured to retain the hinge member 214 to the hinge bracket 212 by providing a resistance to the movement of the hinge member 214 in the direction transverse, such as perpendicular, to the axis of rotation 220. Here, both of the hinge member 214 and the hinge bracket 212 comprise a respective location feature 217, 219 for locating the other of the hinge member 214 or hinge bracket 212 relative to the axis of rotation 220. The location features are configured to centre the hinge member 214 relative to the hinge bracket 212, on the axis of rotation 220. The location features 217, 219 here provide at least a contribution to the force threshold, such as providing a mechanical resistance to the disconnection of the hinge member 214 from the hinge bracket 212 in at least some directions transverse to the axis of rotation 220. In at least some examples, the location features 217, 219 provide a lower mechanical resistance to the disconnection of the hinge member from the hinge bracket in some transverse directions compared to other transverse directions (e.g. lower in a direction parallel to the leaf in a neutral position, such as shown in FIG. 5). The coupling arrangement comprises a plug-and-socket type arrangement. Here, each of the hinge member 214 and hinge bracket 212 comprises a recess for receiving a portion of the other of the hinge member 214 and hinge bracket 212, the location features 217, 219 comprising corresponding projections or protrusions of the other of the hinge member 214 and hinge bracket 212. The location features 217, 219 comprise mechanical location features, comprising a fit between the corresponding portions of the hinge member 214 and hinge bracket 212. Each of the hinge member 214 and the hinge bracket 212 comprises a recess for receiving a portion of the other of the hinge member 214 and the hinge bracket 212. The hinge member 214 and the hinge bracket 212 comprise concentrically-arranged location features 217, 219, each with a recess located diametrically outside a protrusion, at least when the hinge member 214 is coupled to the hinge bracket 212. The hinge member 214 and the hinge bracket 212 comprise coaxially-aligned location features 217, 219, along the axis of rotation 220, at least when the hinge member 214 is coupled to the hinge bracket 212. The location features 217, 219 are concentrically arranged around the axis of rotation 220. Here, the location features 217, 219 comprise swept profiles, about the axis of rotation 220, shown here as full rings or toruses about 360 degrees. The hinge bracket 212 and hinge member 214 each comprise a corresponding circular location feature 217, 219 for engaging the other 214, 212. The location feature 219 of the hinge bracket 212 comprises a ring-shaped or circular recess for receiving the ring-shaped or circular protrusion location feature 217 of the hinge member 214 (and vice versa). Here, the hinge biasing means 224 also comprises a location feature—locating and centring the hinge member 214 relative to the hinge bracket 212, about the axis of rotation 220. Accordingly, the coupling arrangement here comprises a mechanical and a magnetic location feature, each assisting in locating the hinge member 214 relative to the axis of rotation 220 and the hinge bracket 212. Here the magnetic hinge biasing means 224 comprises a primary location feature, the primary location feature being a dominant location feature relative to the mechanical location features 217, 219, providing a greater locating force at least when the hinge member 214 and hinge bracket 212 are coupled.

As with FIG. 8, here in FIG. 11 the key is inserted via a key escutcheon 234 into a lock barrel 236. As the key is turned, the lock barrel 236 and an associated helical insert 238 rotate and mechanically pull a sleeve 250 upwards. In doing so, the washer 230 in the hinge bracket 212 is drawn upwards, away from the magnet 226; and lessens the magnetic attraction between the magnet 226 and the washer 230 in the hinge bracket 212. Vertical movement is achieved by a spring pin 260 guided by a helix spiral feature on the helical insert 238. By offering up the hinge member 214

(attached to the leaf), the magnet 226 drops down favouring the magnetic pull of the washer 228 of the hinge member 214. It will be appreciated, that the hinge member 214 must be reconnected whilst the hinge 210 is in the reconnection configuration of FIG. 11 (i.e. with the key present). Once the key is removed (after rotating back to position of FIG. 9 to allow key removal), the hinge member 214 can no longer be reconnected (in an absence of attraction to the washer 228 of the hinge member 214, the magnet 226 returns to the inactive position of FIG. 10).

Figure 14:
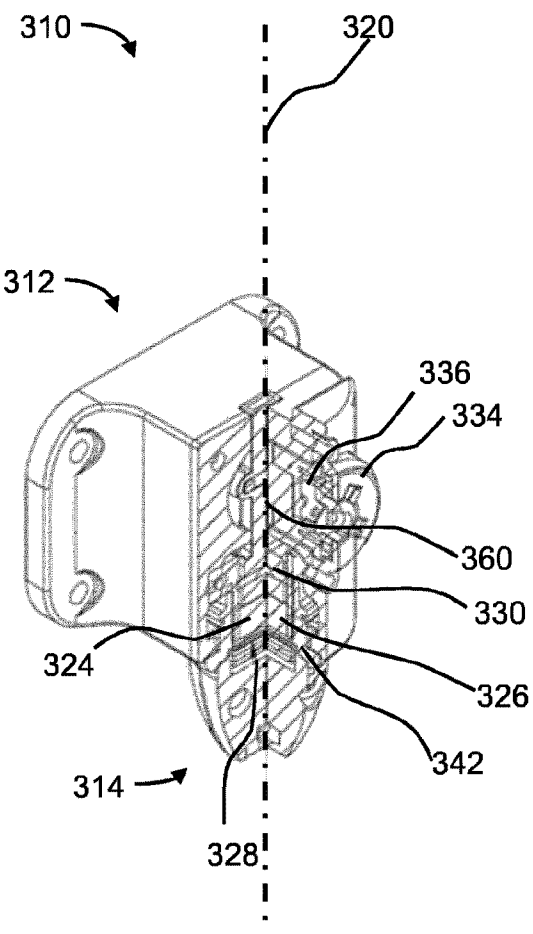
FIG. 14 shows the hinge of FIG. 12 in a reconnection configuration.
Figure 13:
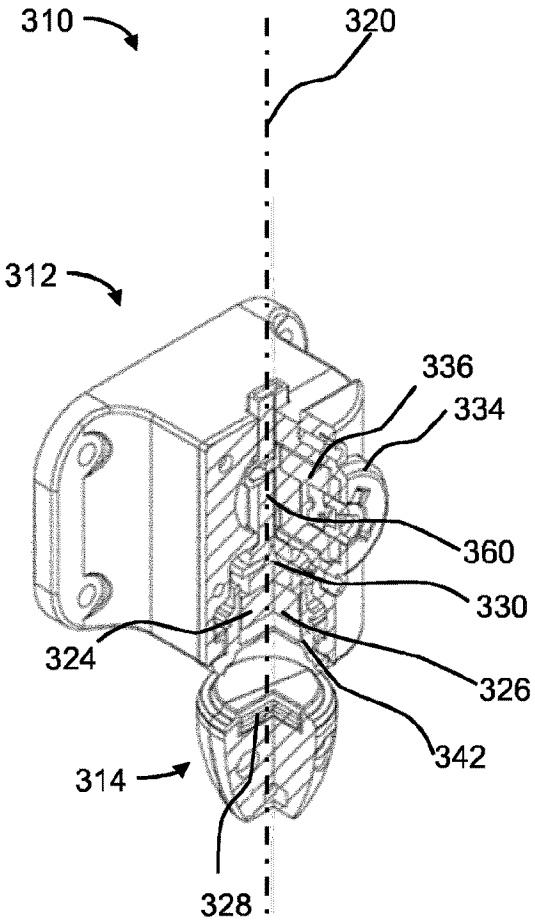
FIG. 13 shows the hinge of FIG. 12 in a disconnected configuration.
Figure 12:
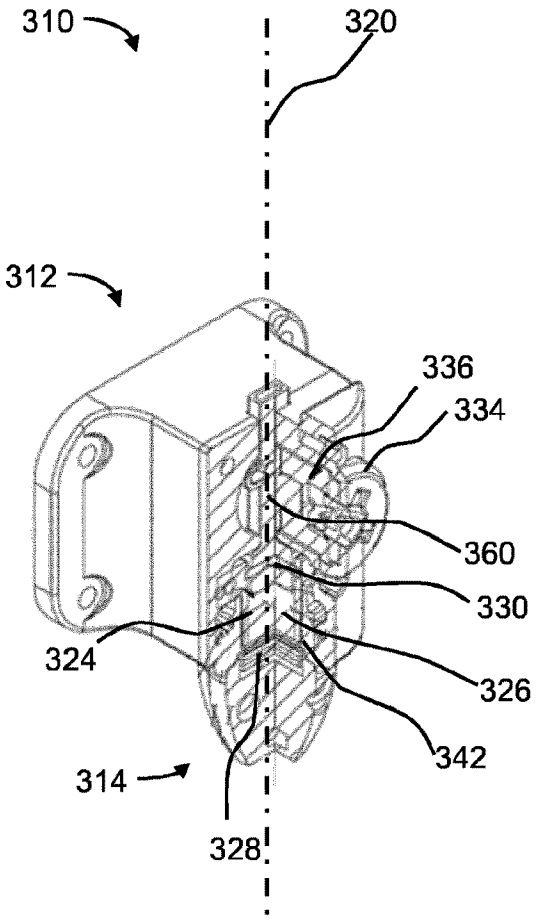
FIG. 12 shows an isometric view of a further example of a hinge according to the disclosure, the hinge shown in partial cross-section with the hinge in a normal use configuration.

Referring now to FIGS. 12, 13 and 14, there are shown isometric partial cross-sectional views of a further example of a hinge 310 in respective normal use, disconnected and reconnection configurations. The hinge 310 is generally similar to that shown in FIGS. 9, 10 and 11, with similar features referenced by similar reference numerals, incremented by 100. Accordingly, the hinge 310 of FIG. 12 comprises a hinge bracket 312 and a hinge member 314. For conciseness, not all references are repeated.

Again here the hinge member 314 is connected to the hinge bracket 312 and held in place by a magnetic pull between a magnet 326 in the hinge bracket 312 and a ferromagnetic washer 328, as shown in FIG. 12. The hinge bracket comprises a scotch yoke 360 for engaging the magnet 326.

As with the hinge 210 of FIG. 10, the hinge member 314 is disconnected and detached from the hinge bracket 312 when a force threshold is reached, as shown in FIG. 13. As can be seen, the hinge member 314 has been displaced downwards from the hinge bracket 312, such as in response to an excessive force acting on an associated leaf (not shown). As can be seen when comparing FIG. 13 to FIG. 12, the hinge biasing means 324 has been reconfigured from an active configuration for normal use in FIG. 12 to an inactive configuration in FIG. 13, caused by the removal of the hinge member 314. Here, the magnet 326 has been drawn axially upwards by a magnetic force of attraction between the hinge biasing means 324 and a magnetic material in the form of a ferromagnetic washer 330 in the hinge bracket 312. The magnetic force between the magnet 326 and the washer 330 in the hinge bracket 312 has become stronger than the magnetic force between the magnet 326 and the ferromagnetic washer 328 in the hinge member 314 when the hinge member 314 has become displaced to the position of FIG. 13 (noting also, that the hinge member 314 can be displaced transversely to lessen the attraction force between the washer 328 and the magnet 326).

As with FIG. 11, here in FIG. 14 the key is inserted via a key escutcheon 334 into a lock barrel 336. As the key is turned, the lock barrel 336 and an associated Scotch Yoke 360 is mechanically pushed downwards. In doing so, the magnet 326 is pushed downwards, away from washer 330 in the hinge bracket 312; and lessens the magnetic attraction between the magnet 326 and the washer 330 in the hinge bracket 312. By offering up the hinge member 314 (attached to the leaf), the magnet 326 drops down favouring the magnetic pull of the washer 328 of the hinge member 314. It will be appreciated, that the hinge member 314 must be reconnected whilst the hinge 310 is in the reconnection configuration of FIG. 14 (i.e. with the key present). Once the key is removed (after rotating back to position of FIG. 12 to allow key removal), the hinge member 314 can no longer be reconnected (in an absence of attraction to the washer 328 of the hinge member 314, the magnet 326 returns to the inactive position of FIG. 13). Accordingly, the reconnection configuration can be considered temporary, such as only when the key is present.

In at least some examples, a same key is for a plurality of systems. For example, where a similar hinge 310 is comprised in a plurality of leaf systems, the key is operable in each of those systems. Additionally, or alternatively, particularly where there are multiple systems co-located, such as a plurality of door-based systems in a building; or a plurality of discrete systems in a room (e.g. for a plurality of doors and/or window/s and/or fixture/s), then the same key is operable in each of those systems. In at least some examples, the same key is operable in further systems in addition to the hinge. For example, the key is a universal key operable in related systems, such as one or more of: a door access key; a barricade reset key; a viewing panel key. For example, it will be appreciated that a similar key may be suitable for each example hinge above. Alternatively, keys may be specific to a particular hinge or system, or a particular group of hinges or systems.

It will be appreciated that in at least some examples the magnets shown can act as a leaf-biasing means, so as to bias the door closed. For example, an embodiment with multiple discrete magnets such as shown in FIGS. 6-8, can have the magnets alternately oriented (e.g. north then south then north then south) about the axis of rotation 120. A hinge member may have inserts such as ferromagnetic inserts (or even corresponding magnets) that are positioned rotationally about the axis of rotation 120 relative to the magnets in the hinge bracket (e.g. south then north then south then north) so that the leaf is biased closed, within an arc of use of 180° (or just under), such as almost 90° inwards and outwards (with that arrangement of magnets).

Figure 17:
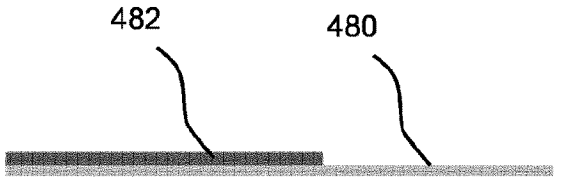
FIG. 17 shows a partial cross-sectional view of the assembled leaf of FIG. 16.
Figure 16:
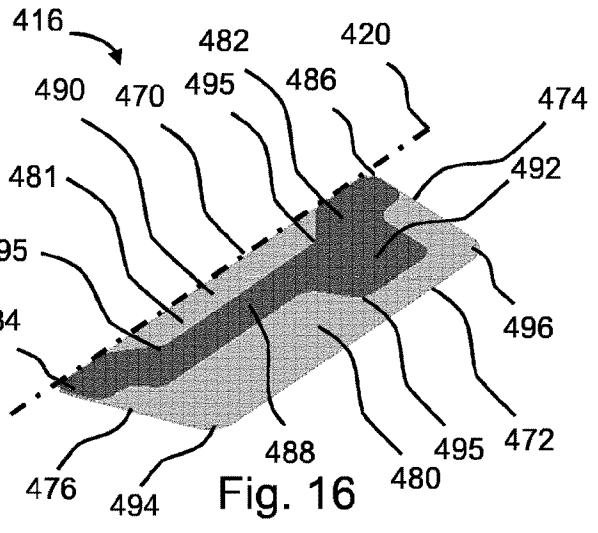
FIG. 16 shows an isometric view of the assembled leaf of FIG. 15.
Figure 15:
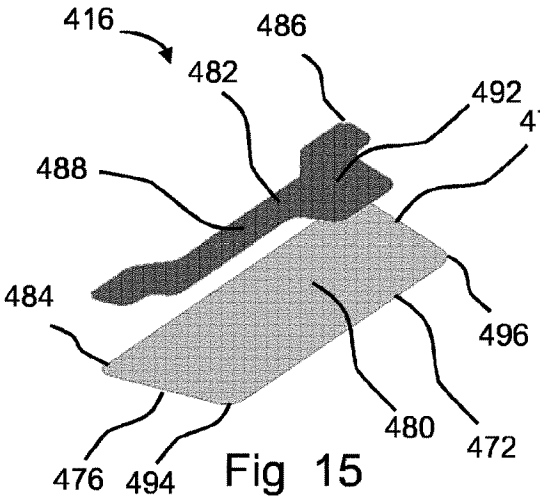
FIG. 15 shows an isometric exploded view of an example leaf of this disclosure.

Referring now to FIG. 15, there is shown an isometric exploded view of an example leaf 416; with FIG. 16 showing the leaf 416 assembled; and FIG. 17 showing a partial cross-section of the leaf 416.

Here, the leaf 416 comprises a anti-barricade, anti-ligature door leaf. The leaf 416 is for a saloon-style double-action door (also known as a double-swing door), which can open both ways (e.g. inwards and outwards). The leaf 416 is configured to provide a clearance or opening between the leaf 416 and a frame when in a closed position, with a clearance above and below the leaf 416, similar to that shown in FIG. 1. The clearance or opening is visible, providing at partial sight into or through the frame or doorway even when the leaf 416 is closed. The clearance here is at least 10 cm above and below the leaf 416. The door comprises a privacy door, such as for a bathroom, a restroom, a toilet, a changing room, a dressing room, or the like. The leaf 416 comprises a quadrilateral or substantially quadrilateral form or structure, with a hanging edge 470 opposite a leading edge 472 of the leaf, with a top edge 474 and a bottom edge 476 respectively extending between the hanging and leading edges 470, 472. The leaf 416 defines a leaf plane, such as a medial leaf plane, with each edge 470, 472, 474, 476 lying on the plane. When mounted, the top edge 474 slopes downwards towards the leading edge 472. The quadrilateral comprises a rectangle, trapezium, or parallelogram. The leaf 416 here defines a D-shaped outline.

The leaf 416 comprises an anti-weaponisation leaf. The leaf 416 is configured to prevent or at least mitigate a risk of injury associated with a use of the leaf 416 as a weapon. The leaf 416 is configured to prevent or mitigate a risk of injury associated with impact with the leaf 416, particularly where the leaf 416 is loose or detached from its hinge/s or frame. The leaf 416 is configured to prevent or mitigate against damage to objects or property by the leaf 416, particularly when the leaf 416 is detached from its frame or hinge/s or frame.

The leaf 416 comprises a non-uniform stiffness. The leaf 416 comprises an anisotropic stiffness. The leaf here 416 comprises a varying or varied stiffness extending across the leaf 416, in the plane of the leaf. The leaf 416 comprises a non-uniform stiffness in a direction extending between the hanging edge 470 and the leading edge 472. Additionally, here, the leaf 416 comprises a non-uniform stiffness in a direction extending substantially parallel to the hanging and leading edges 470, 472. The leaf 416 comprises a non-uniform stiffness extending in a direction between the top and bottom edges 474, 476. The leaf 416 comprises a multi-stiffness leaf, with at least two portions of differing stiffness, here shown as a first portion 480 comprising a different stiffness from a second portion 482.

Here, the leaf 416 comprises two flexible portions 480, 481. The first flexible portion 480 comprises a flexible leading edge portion; a flexible top edge portion; a flexible bottom edge portion. Here, the leaf 416 comprises a continuous flexible portion 480 extending continuously around at least portions of the bottom, leading and top edges 476, 472, 474. The flexible portions 480, 481 are configured to deflect or deform in a direction transverse to the leaf plane. Additionally, here, the flexible portions 480, 481 are configured to deflect or deform in a direction of or parallel to the leaf plane. The first flexible portion 480 extends uninterrupted around the top, leading and bottom edges 474, 472, 476, as can be seen in FIG. 16. The second flexible portion 481 extends for a substantial portion of a length of the hanging edge 470, here being a majority of the hanging edge 470 between two connection points 484, 486.

The flexible portions 480, 481 comprises a maximum thickness. Here, the edges 470, 472, 474, 476 comprise a corresponding maximum thickness. As shown here, the maximum thickness of the flexible portions 480, 481 comprises 0.5 mm. Providing flexible portions 480, 481 and edges 470, 472, 474, 476 with a maximum thickness helps ensure that the flexible portions 480, 481 and edges 470, 472, 474, 476 comprise a stiffness below a stiffness threshold and a flexibility above a flexibility threshold.

The flexible portions 480, 481 and edges 470, 472, 474, 476 comprise a minimum thickness. Here, the minimum thickness comprises 0.5 mm. Ensuring that the edges 470, 472, 474, 476 comprise a minimum thickness may assist in preventing or mitigating use of an edge 470, 472, 474, 476 for damage. For example, particularly where an edge 470, 472, 474, 476 is rounded, then providing a minimum thickness may allow a minimum radius corresponding to half the thickness. Ensuring that the minimum radius can be above a threshold may reduce a risk of the edge 470, 472, 474, 476 being suitable for stress concentrations or cutting, for example reducing a risk of cuts like 'papercuts' such as where the edge 470, 472, 474, 476 is held under tension.

Here, the flexible edge portions 470, 472, 474, 476 are sufficiently thin to be deformable whilst being sufficiently thick to provide a sufficiently large radius to mitigate against cuts.

The leaf 416 comprises one stiff portion 482. The stiff portion 482 is stiff relative to the flexible portions 480, 481, comprising a substantially greater stiffness than the flexible portions 480, 481. The stiff portion 482 comprises a rigid portion. The stiff portion comprises 482 an increased thickness of the leaf 416, here being localised increased thickness of the leaf 416 in multiple portions of the leaf 416. The increased thickness is relative to the thickness of the flexible portions 480, 481. Here, the leaf 416 comprises a single stiff portion 482.

Here, the stiff portion 482 is generally spaced from each of the leaf's edges 470, 472, 474, 476 by a minimum spacing of the flexible portions 480, 481 of at least around 50 mm to around 100 mm.

The stiff portion 482 comprises a reinforcement. Here, the stiff portion 482 is formed of a similar material to the flexible portions 480, 481. The stiff portion 482 comprises a greater thickness than the flexible portions 480, 481. The stiff portion 482 comprises a greater thickness of the same material of the flexible portions 480, 481.

The stiff portion 482 comprises a spine 488. The spine 488 extends between the two connection points 484, 486 of the leaf 416, corresponding to a pair of hinge areas or nibs of the leaf 416. The spine 488 extends continuously between the two connection points 484, 486. As shown in FIG. 16, the leaf 416 comprises a gap 490 separating a portion of the spine 488 from the hanging edge 470. The hanging edge 470 is coincident with or parallel to a rotation axis of the leaf 416, such as defined by a hinge/s. At least a portion of the spine 488 is spaced from the hanging edge 470 and the axis of rotation 420, being separated from the hanging edge 470 by the second flexible portion 481. here, a substantial majority of the spine 488 is spaced from the hanging edge 470.

The stiff portion 482 is configured to allow hinged opening and/or closing of the leaf 416. The stiff portion 482 is configured to enable the leaf 416 to hinge before deforming beyond a deformation threshold. For example, the stiff portion 482 allows the leaf 416 to open by rotation about its hinge axis 420 under a force or moment applied by a user's hand to the leaf 416. Accordingly, the stiff portion 482 translates a pushing force to the hinges reducing the deflection of the leaf 416 in comparison to pushing on only a flexible portion 480. Accordingly the leaf 416 is configured to maintain a more familiar feeling, which is important for impaired users.

The stiff portion 482 comprises a user contact point 492. The user contact point 492 comprises an area or portion of the leaf 416 intended for interaction with a user, such as for a user to push the leaf 416 to open. The stiff portion 482 connects the user contact point 492 with both of the connection points 484, 486. Here, the stiff portion 482 comprises a spine 488 extending longitudinally vertically between the hinges and laterally towards the user contact point 492. The user contact point 492 is located towards the leading edge 472, here being closer to the leading edge 472 than to the hanging edge 470. The user contact point 492 is located more towards the top edge 474 than the bottom edge 476. In other embodiments (not shown) the user contact point 492 is located more towards the bottom edge 476 than the top edge 474. The user contact point 492 is configured to transmit torque from contact with a user to the leaf's hinge/s. The user contact point 492 is configured to provide feedback such as reassurance to a user. The user contact point 492 is configured to be accessible by walking and/or wheelchair users. The leaf 416 comprises an axial stiffness, provided by the stiff portion 482, to operate (turn) the hinge, which comprises a spring return (e.g. self-closing). The leaf 416 is configured to hinge open under a force of 2-4N applied at the user contact point 492. The user contact point 492 comprises a spacing from the leaf hinge axis 420 of around 450 mm. The stiff portion 482 is configured to prevent the leaf 416 deflecting back on itself and presenting a consistent physical barrier and hindering wheelchair access, etc.

The stiff portion 482 comprises a reinforcement. The stiff portion 482 is configured to prevent or inhibit deformation of the leaf 416, such as to prevent or inhibit rolling of the leaf 416 (e.g. into a tube).

The stiff portion 482 comprises a maximum thickness here of 1.7 mm. Providing a stiff portion 482 with a maximum thickness may help ensure that the leaf 416 as such comprises an overall stiffness below an overall stiffness threshold and an overall flexibility above an overall flexibility threshold. Accordingly, the leaf 416 as a whole may be sufficiently unwieldy as to reduce a risk of weaponization. Providing a maximum thickness may assist in keeping an overall weight of the leaf 416 below a weight threshold, mitigating against the leaf 416 being used as a weapon.

The leaf comprises a first leaf material with a flexural modulus of around 1.5 GPa and a flexural strength of around 40 MPa. Here, the first leaf material comprises polypropylene. Both the flexible portions 480, 481 and also the stiff portion 482 comprises the first leaf material. As can be seen from FIG. 17, the leaf 416 comprises variations in thickness corresponding to the flexible 480 (and 481, not shown) and stiff portions 482. The leaf 416 comprises a same first leaf material for the stiff and flexible portions 480, 481, 482 with the variations in stiffness being provided by variations in thickness.

As can be seen from FIGS. 15 and 17 in particular, the leaf 416 is formed of two layers of the first leaf material. The reinforcement for the stiff portion 482 comprises an additional layer of the first leaf material relative to the flexible portions 480, 481. The layers are surface bonded here by an industrial double-sided adhesive tape with a thickness of around 0.05 mm to form the assembled leaf 416 of FIG. 16.

As will be appreciated from FIG. 16, the leaf 416 comprises flexible corners 494, 496, where the leading edge 472 meets the top and bottom edges 474, 476 respectively, the corners 494, 496 being comprised in the flexible portion 480.

The leaf edge corners 494, 496 comprises a minimum radius in or parallel to the leaf plane. Here, the edge corners 494, 496 comprise a minimum radius of at least 10 mm. Providing the leaf edge corners 494, 496 with a minimum radius may reduce a risk of injury or damage.

The leaf 416 comprises multiple internal corners 495 within the leaf 416. The internal corners 495 are defined by the stiff portion 482 and comprise a minimum radius of at least 5 mm. Providing the internal corners 495 with a minimum radius may reduce a risk of peeling.

As can be appreciated from FIG. 15, the leaf 416 here is formed from a 0.5 mm layer of polypropylene bonded to a reduced area layer of 1.2 mm polypropylene to form the stiff portion 482.

Figure 20:
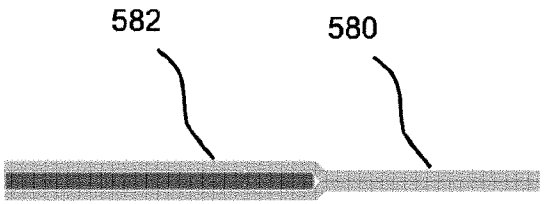
FIG. 20 shows a partial cross-sectional view of the assembled leaf of FIG. 19.
Figure 19:
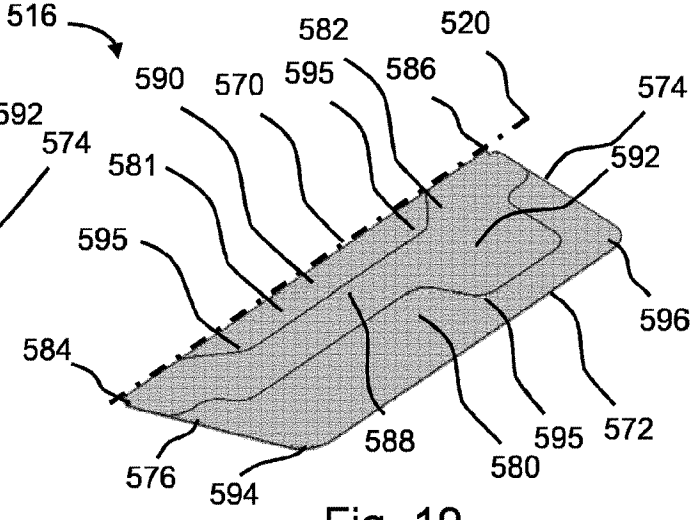
FIG. 19 shows an isometric view of the assembled leaf of FIG. 18.
Figure 18:
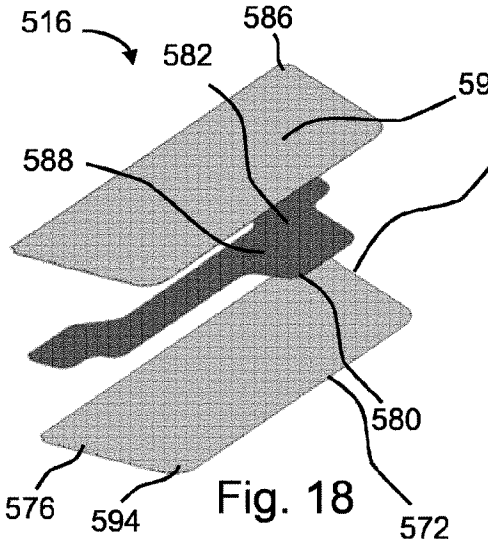
FIG. 18 shows an isometric exploded view of another example leaf of this disclosure.

Referring now to FIGS. 18, 19 and 20, there is shown a further leaf 516, generally similar to that shown in FIGS. 15 to 17, with similar features denoted by similar reference numerals increment by 100. Accordingly, the leaf 516 has a hanging edge 570 and a leading edge 572. Here, the leaf 516 is formed by sandwiching a reinforcement layer of 1.2 mm polypropylene between two layers of 0.25 mm polypropylene to form a stiff portion 582 of 1.7 mm polypropylene (excluding adhesive thickness) and flexible portions 580, 581 of 0.5 mm (excluding adhesive thickness) polypropylene. Again here, the stiff portion 582 is generally spaced from each of the leaf's edges 570, 572, 574, 576 by a minimum spacing of the flexible portions 580, 581 of at least around 50 mm to around 100 mm (as depicted by "A", "B", "C", and "D" in FIG. 21).

Figure 21:
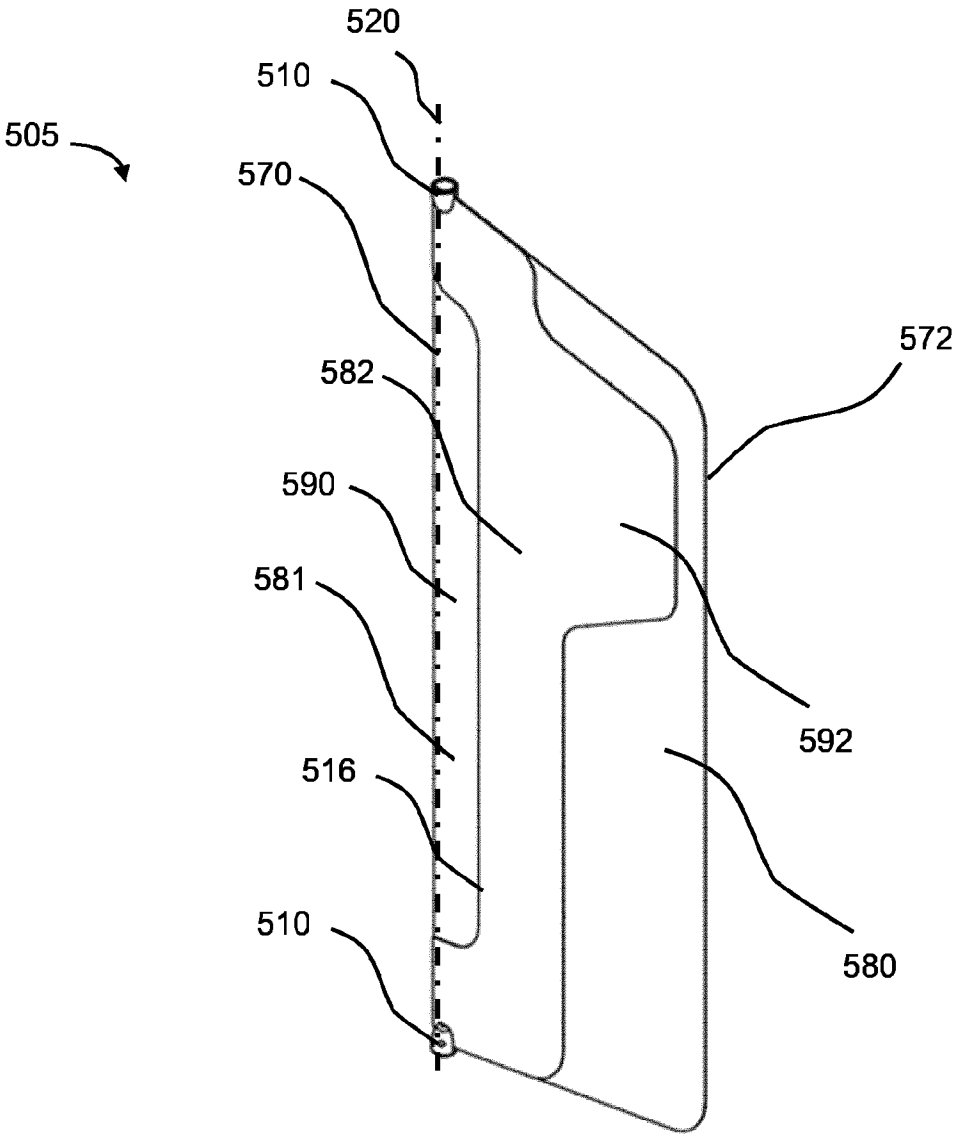
FIG. 21 shows a perspective view of a leaf system with the leaf of FIG. 19.

FIG. 21 shows a perspective view of a leaf system 505 with the leaf 516 of FIG. 19. Here, the leaf 516 is configured to deform under a load applied downwards, such as a load applied downwards from the top of the leaf 516. The leaf 516 is configured to deform sufficiently to allow or enable disconnection from or at the hinge, such as the top hinge 510. The leaf 516 is configured to deform or deflect by bowing in the middle of the leaf 516 (e.g. in one or either outwards direction relative to the plane of the leaf 516). The leaf 516 here will deform in this manner under a load of 0.3 kg when not connected to the pivot. When mounted by the hinge 510, the actual disconnecting force of the nib to the pivot is 3 kg.

The leaf 516 is configured to interact with the hinge 510 to allow the nib to slip outwards unimpeded due to a chamfer at the nib interaction of the leaf 516 at the hinge 510. The leaf 516 is configured to allow twisting/buckling at the bottom of the leaf 516 to enable the bottom nib to slip under a load of 0.5 kg. here, the leaf 516 comprises a non-sealing door. The flexible portions 580, 581 comprises non-sealing portions. The leaf 516 comprises a handle-less leaf 516, devoid of surface features on both planar surfaces (e.g. front and back), such as surface protrusions, fixings or fastenings—other than the hinges 510 for hanging or hinging purposes.

It will be appreciated that any of the aforementioned apparatus may have other functions in addition to the mentioned functions, and that these functions may be performed by the same apparatus.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims.

The applicant indicates that aspects of the present invention may consist of any such individual feature or combination of features. It should be understood that the embodiments described herein are merely exemplary and that various modifications may be made thereto without departing from the scope or spirit of the invention. For example, it will be appreciated that although shown here as a door hinge mounted to a wall or frame, in other examples other members or fittings may be attached (such as gates or shutters or fixtures from ceilings, walls or the like). Likewise, although shown here as a pair of oppositely-oriented hinges (e.g. facing each other), in at least some embodiments, the pair of hinges may be similarly oriented (e.g. both brackets facing upwards for similar load-bearing). Similarly, although shown here with magnets, at least some examples are magnet-free. For instance, in at least some examples an axially-movable member, such as the Scotch Yoke of FIG. 12, may be spring-mounted (biased downwards as shown) to bias a member, such as a pin or the like into volume that would be occupied by the hinge member when connected. Such a sprung pin may be primarily a re-insertion prevention member, to prevent the hinge member being re-inserted. For example, a sprung grub-pin, grub-screw or the like may act perpendicularly to the sprung yoke (e.g. horizontally) to lock the yoke in an extended (e.g. downwards position) when the leaf member is removed. The sprung grub-screw may only be releasable with a key, similarly to the Figures described above.

The invention claimed is:

1. An anti-ligature hinge for a door, the hinge comprising:
a hinge bracket operatively associable with a support; and
a hinge member operatively associable with a leaf;
wherein the hinge is configured so that the hinge member is connectable by an inter-engaging coupling arrangement to the hinge bracket, with the hinge member being rotatable relative to the hinge bracket about an axis of rotation;
wherein the hinge is configured so that the hinge member is disconnectable from the hinge bracket in response to at least one threshold force, the at least one threshold force being less than a force required to create or support a ligature, the at least one threshold force being selected from one or more of:
a transverse threshold force comprising a transverse force component transverse to the axis of rotation, the transverse threshold force being the same in at least two directions transverse to the axis of rotation; and/or
an axial threshold force comprising a force component acting along the axis of rotation.

2. The hinge of claim 1, wherein the hinge member is connected to the hinge bracket by a hinge biasing means.

3. The hinge of claim 2, wherein the hinge biasing means exerts a hinge biasing force along the axis of rotation biasing the hinge member towards the hinge bracket.

4. The hinge of claim 2, wherein the hinge biasing means at least partially determines the at least one threshold force.

5. The hinge of claim 1, wherein the hinge member is connected to the hinge bracket with a hinge biasing member providing a magnetic hinge biasing force.

6. The hinge of claim 1, wherein the transverse direction comprises a direction in a plane perpendicular to the axis of rotation, the hinge member being disconnectable from the hinge bracket in response to the transverse force threshold being reached, the transverse force threshold being the same for any direction of force in the plane perpendicular to the axis of rotation.

7. The hinge of claim 1, wherein the hinge comprises a leaf biasing means, the leaf biasing means biasing the leaf towards a closed position.

8. The hinge of claim 1, wherein the hinge is configured to impede reconnection of the hinge member and the hinge bracket following disconnection.

9. The hinge of claim 1, wherein the hinge requires an action or intervention by an authorised user to enable reconnection of the hinge member to the hinge bracket.

10. The hinge of claim 9, wherein the hinge requires resetting with a key prior to reconnection.

11. The hinge of claim 1, wherein the hinge comprises a bearing for guiding the relative rotational movement between the hinge bracket and hinge member, the bearing being housed at least partially internally or concealed within the hinge.

12. A leaf system comprising:
(i) at least one anti-ligature hinge for a door, the hinge including:
a hinge bracket operatively associable with a support; and
a hinge member operatively associable with a leaf;
wherein the hinge is configured so that the hinge member is connectable by an inter-engaging coupling arrangement to the hinge bracket, with the hinge member being rotatable relative to the hinge bracket about an axis of rotation;
wherein the hinge is configured so that the hinge member is disconnectable from the hinge bracket in response to at least one threshold force, the at least one threshold force being less than a force required to create or support a ligature, the at least one threshold force being selected from one or more of a transverse threshold force comprising a transverse force component transverse to the axis of rotation, the transverse threshold force being the same in at least two directions transverse to the axis of rotation, and/or an axial threshold force comprising a force component acting along the axis of rotation; and
(ii) at least one leaf.

13. The leaf system of claim 12, wherein the leaf system comprises a plurality of hinges.

14. The leaf system of claim 13, wherein the plurality of hinges comprises at least a pair of hinges, the pair of hinges being aligned on the same axis of rotation.

15. The leaf system of claim 14, wherein the pair of hinges is oppositely-oriented.

16. The leaf system of claim 15, wherein the at least one leaf comprises a single leaf supported by the pair of hinges, with the pair of hinges being located at or towards a top and a bottom of the single leaf respectively.

17. The leaf system of claim 16, wherein the leaf is mounted between the hinges with the leaf being positioned on the axis of rotation so that the axis of rotation passes directly through the leaf, such that the leaf is bidirectionally rotatable about the axis of rotation under a similar magnitude of force.

18. The leaf system of claim 14, wherein the leaf comprises a double-action saloon-style anti-ligature door leaf, which can open both ways, and wherein the leaf does not protrude or extend axially beyond either hinge, the leaf extending axially only between the hinges.

19. A method of hinging a leaf, the method comprising
operatively associating a hinge bracket with a support;
operatively associating a hinge member with the leaf;
connecting the hinge member to the hinge bracket by an inter-engaging coupling arrangement, with the hinge member being rotatable relative to the hinge bracket about an axis of rotation;
disconnecting the hinge member from the hinge bracket in response to at least one force threshold, the at least one threshold force being less than a force required to create or support a ligature, the at least one threshold force being selected from one or more of:
a transverse threshold force comprising a transverse force component transverse to the axis of rotation, the transverse threshold force being the same in at least two directions transverse to the axis of rotation; and/or
an axial threshold force comprising a force component acting along the axis of rotation.

* * * * *